US008213825B2

(12) United States Patent
Sato

(10) Patent No.: US 8,213,825 B2
(45) Date of Patent: Jul. 3, 2012

(54) CARTRIDGE WITH URGING MEMBERS

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/830,473

(22) Filed: Jul. 6, 2010

(65) Prior Publication Data

US 2011/0002709 A1 Jan. 6, 2011

Related U.S. Application Data

(62) Division of application No. 11/624,475, filed on Jan. 18, 2007, now Pat. No. 7,761,025.

(30) Foreign Application Priority Data

Jan. 19, 2006 (JP) ..... 2006-011424

(51) Int. Cl.
*G03G 15/00* (2006.01)
*G03G 15/04* (2006.01)

(52) U.S. Cl. ..... 399/90; 399/119

(58) Field of Classification Search ..... 399/90, 399/119, 110, 111, 112
See application file for complete search history.

(56) References Cited

U.S. PATENT DOCUMENTS

| | | | | |
|---|---|---|---|---|
| 5,761,589 | A * | 6/1998 | Kido et al. | 399/284 |
| 6,151,465 | A | 11/2000 | Toba et al. | |
| 6,885,835 | B2 | 4/2005 | Seo | |
| 7,702,253 | B2 | 4/2010 | Nishimura | |
| 2004/0028424 | A1 * | 2/2004 | Yokoi | 399/90 |
| 2005/0069347 | A1 | 3/2005 | Okabe | |
| 2005/0141909 | A1 * | 6/2005 | Takahashi et al. | 399/53 |
| 2005/0191089 | A1 | 9/2005 | Nishimura | |

FOREIGN PATENT DOCUMENTS

| | | |
|---|---|---|
| JP | 02-067362 | 5/1990 |
| JP | 2-131254 A | 5/1990 |
| JP | 3-256078 A | 11/1991 |
| JP | 05-300292 | 11/1993 |
| JP | 07-234564 | 9/1995 |
| JP | 09034256 | 2/1997 |
| JP | 11316503 | 11/1999 |
| JP | 2000181264 | 6/2000 |
| JP | 2000250310 | 9/2000 |
| JP | 2000-352921 | 12/2000 |
| JP | 2002-341728 | 11/2002 |
| JP | 2003-043803 | 2/2003 |
| JP | 2004252179 | 9/2004 |
| JP | 2005107189 | 4/2005 |
| JP | 2005-242066 | 9/2005 |

OTHER PUBLICATIONS

Notification of Reasons for Refusal in corresponding Japanese Application 2006-011424 mailed on Jan. 25, 2011.
Office Action recieved for corresponding Japanese Patent Application 2010-262093 mailed Feb. 8, 2011.

* cited by examiner

*Primary Examiner* — David Gray
*Assistant Examiner* — Billy J Lactaoen
(74) *Attorney, Agent, or Firm* — Banner & Witcoff, Ltd.

(57) ABSTRACT

A cartridge set in a main body of an image forming apparatus including a developer roller positioned opposite a photosensitive member and a frame including the developer roller and in contact with an urging unit, wherein the urging unit is structured to urged the developer roller towards the photosensitive member, also the urging unit is structured to transfer a voltage from a power supply unit to the developer roller.

6 Claims, 29 Drawing Sheets

CARTRIDGE WITH URGING MEMBERS

CROSS REFERENCE TO RELATED APPLICATION

This application is a divisional of U.S. patent application Ser. No. 11/624,475, filed Jan. 18, 2007, which is based upon and claims the benefit of priority from prior Japanese Patent Application No. 2006-011424 filed Jan. 19 2006. The entire content of these priority applications is incorporated herein by reference.

TECHNICAL FIELD

The disclosure relates to a cartridge and an image forming apparatus.

BACKGROUND

In conventional structure, an image forming apparatus that has a process cartridge is disclosed. The process cartridge has developer cartridge that includes a developer roller, and also includes a drum cartridge having a photosensitive drum. The process cartridge is generally structured to dispose a photosensitive drum opposite a developer roller for performing development. The process cartridge has a urging member for urging the developer roller against the photosensitive drum and a power supply member for supplying power to the developer roller.

However, because the urging unit is separately disposed from the power supply member, the power supply member may interfere with the action of the developer cartridge. This may fail to stably bring the developer roller into the development position.

SUMMARY

A cartridge set in a main body of an image forming apparatus including a developer roller positioned opposite a photosensitive member and a frame including the developer roller in contact with an urging unit, wherein the urging unit is structured to urged the developer roller towards the photosensitive member, also the urging unit is structured to transfer a voltage from a power supply unit to the developer roller.

BRIEF DESCRIPTION OF THE DRAWINGS

Illustrative aspects in accordance with the invention will be described in detail with reference to the following figures wherein.

DETAILED DESCRIPTION

1. General Structure

Figure 1:
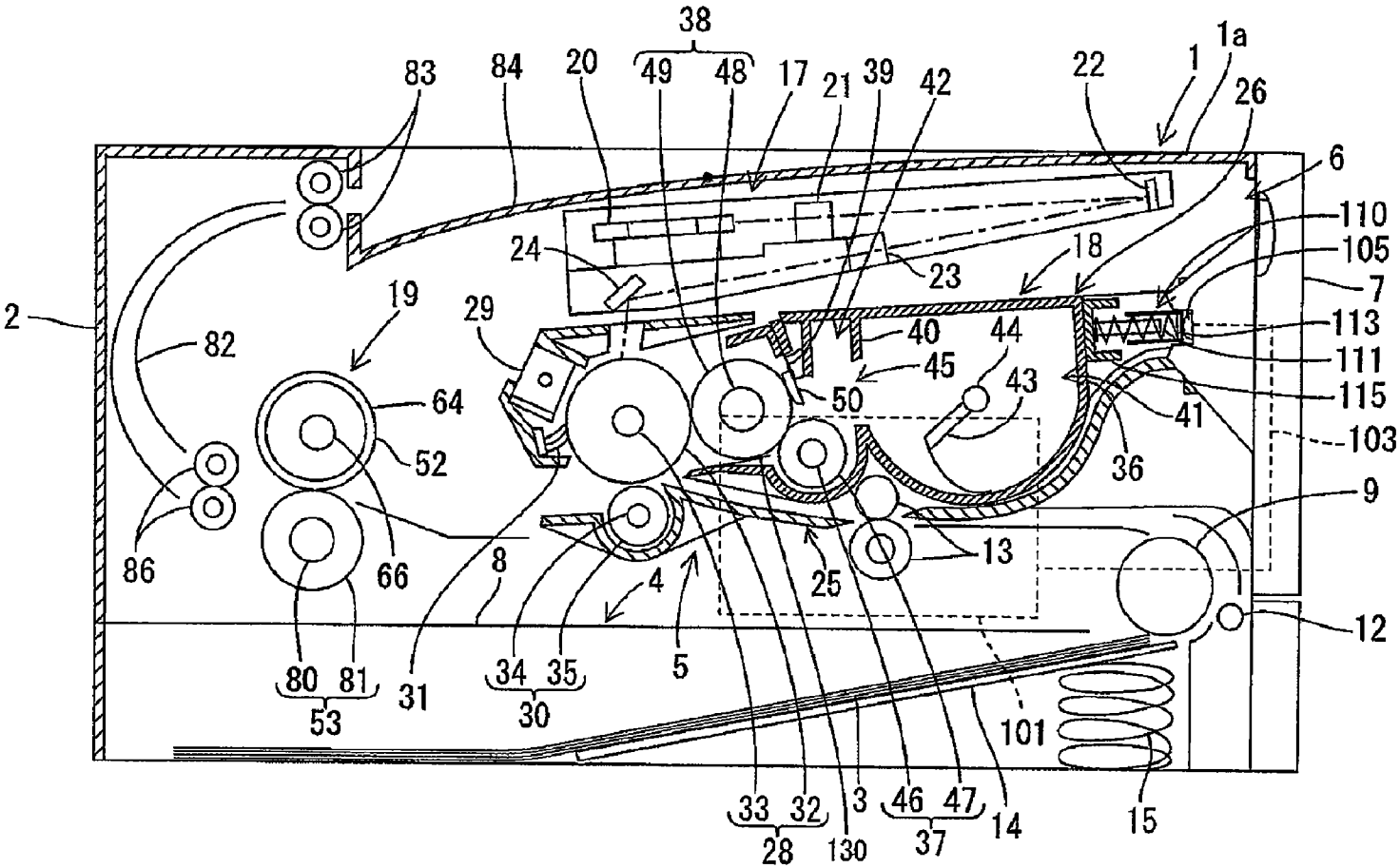
FIG. 1 is a sectional side elevation schematically showing a laser printer as an image forming apparatus according to one aspect of the invention.

FIG. 1 is a sectional view schematically showing a portion of a laser printer as an image forming apparatus according to one aspect of the invention. A laser printer 1 includes a feeder 4 that feeds a sheet 3 as a recording medium, an image forming unit 5 that forms an image on the sheet 3 fed by the feeder 4, and the like, which are arranged within a body casing 2. Those skilled in the art will appreciate that sheet 3, or a recording medium, can include, but is not limited to paper, plastic, and the like.

An attachment/removal opening 6 through which a process cartridge 18 (to be described later) is attached and removed is formed in one side wall of the body casing 2. A front cover 7 is also provided to open and close the opening 6.

The front cover 7 is rotatably supported at a cover shaft (not shown) that is inserted through the lower end of the front cover 7. When the front cover 7 is closed with respect to the cover shaft as the center, the opening 6 is closed by the front cover 7 as shown in FIG. 1. Meanwhile, when the front cover 7 is opened (tilted) with respect to the cover shaft as a supporting point, the opening 6 is opened such that the process cartridge 18 is attached to or removed from the body casing 2 through the opening 6.

The side of the laser printer 1 and the process cartridge 18 (including a development cartridge 26 to be described later) at which the front cover 7 is attached will be referred to as a "front" side, and the opposite side will be referred to as a "rear side".

The feeder 4 can include a detachably mountable feeder tray 8, a sheet feeder roller 9 and a separation pad (not shown) provided above the front end of the feeder tray 8, a pinch roller 12 opposite the front side of the sheet feeder roller 9, and a resist roller 13 provided above the rear side of the sheet feeder roller 9 on the bottom of the body casing 2.

A platen 14 that allows the sheets 3 to be stacked is provided in the feeder tray 8. The platen 14 is swingably supported at its rear end portion such that its front end portion is movable up and down. A spring member 15 for lifting up the front end of the platen 14 is provided at the front end of the feeder tray 8.

When the front end of the platen 14 is lifted up, the uppermost one of the sheets 3 rested on the platen 14 is pressed by the sheet feeder roller 9. The sheet feeder roller 9 rotates to start feeding the sheet 3.

The sheet 3 fed by the sheet feeder roller 9 is separated and fed one by one. The fed sheet 3 passes between the sheet feeder roller 9 and the pinch roller 12 so as to be fed to a resist roller 13.

The resist roller 13 is formed of a pair of opposite rollers, and functions in feeding the sheet 3 to a transfer position (a position between the photosensitive drum 28 and a transfer roller 30 at which a toner image on the photosensitive 28 is transferred to the sheet 3) of the image forming unit 5.

The image forming unit 5 can include a scanner unit 17, the process cartridge 18, a fixation unit 19, and the like.

The scanner unit 17 is disposed at the upper portion of the body casing 2, and can include a laser source (not shown), a rotatably driven polygon mirror 20, an fθ lens 21, a reflecting mirror 22, a lens 23 and a reflecting mirror 24, respectively. Laser beam radiated from the laser source based on the image data is biased by the polygon mirror 20 (shown as a chain line in FIG. 1) shows to penetrate the fθ lens 21. Then the light path is folded back by the reflecting mirror 22 to further penetrate the lens 23. The light path is further bent downward by the reflecting mirror 24 so as to be irradiated on the surface of the photosensitive drum 28 of the process cartridge 18 (described later) at high speed scanning.

The process cartridge 18 below the scanner unit 17 is detachably set in the main body casing 2. The process cartridge 18 can include a drum cartridge 25 and a development cartridge 26 that is detachably installed to the drum cartridge 25.

The drum cartridge 25, extending in the longitudinal direction, allows the development cartridge 26 to be installed therein at the front side between a pair of side plates 27 (see FIG. 3) generally arranged in a direction perpendicular to the longitudinal direction (hereinafter referred to as a "width direction"). The drum cartridge 25 is can also include the photosensitive drum 28, an electrifier 29 (which can be of the scorotron type), a transfer roller 30, and a cleaning brush 31 at the rear side.

The photosensitive drum 28 can include a cylindrical drum body 32 formed by a positively charged photosensitive layer, and a metallic drum shaft 33 that extends along the drum body 32 in the longitudinal direction. The outermost layer of the cylindrical drum 32 can be formed of such material as polycarbonate, or the like. The drum shaft 33 is supported at both side plates 27 of the drum cartridge 25 so as not to be rotated. The drum body 32 is rotatably supported at the drum shaft 33. Accordingly, the photosensitive drum 28 is rotatably provided between both side plates 27 around the drum shaft 33.

The electrifier 29 is disposed to face the photosensitive drum 28 at an interval so as not to be in contact therewith obliquely upward of the rear side of the photosensitive drum 28. The electrifier 29 for positive charging to allow the charging wire such as tungsten to generate corona discharge is designed to positively charge the entire surface of the photosensitive drum 28.

The transfer roller 30 is rotatably supported at both side plates 27 of the drum cartridge 25 disposed below the photosensitive drum 28 vertically opposite in contact therewith. The transfer roller 30 can be formed by covering a metallic roller shaft 34 with a roller 35 formed of a conductive rubber material or the like. The transfer bias is applied to the transfer roller 30 during the transfer.

The cleaning brush 31 is disposed to the rear of the photosensitive drum 28 such that the leading end of the brush can be brought into contact with the surface of the drum body 32 of the photosensitive drum 28.

The development cartridge 26 is detachably installed in the drum cartridge 25, and provided with a box-like frame portion 36 having an opening at the rear side, a supply roller 37, developer roller 38 and a layer thickness regulating blade 39 disposed within the frame 36.

A partition plate 40 that protrudes downward from the upper surface in the width direction is provided in the frame 36. The inner space forward of the partition plate 40 is defined as a toner storage chamber 41, and the inner space rearward of the partition plate 40 is defined as a development chamber 42, respectively.

The toner storage chamber 41 contains a positively charged toner, which can have a nonmagnetic single content as the developing powder. A polymerized monomer, for example, styrene monomer such as styrene, or a polymerized toner obtained by copolymerizing acrylic monomer, for example, acrylic acid, alkyl (C1 to C4) acrylate, alkyl (C1 to C4) methaacrylate (through the known polymerization method) such as suspension polymerization method may be employed as the toner. The polymerized toner is spherical and exhibits excellent flowability, thus providing high quality image forming.

The toner contains the coloring agent such as carbon black and wax added thereto. An exogenous additive such as silica with a particle size ranging from about 6 to 10 m is added to the toner for improving the flowability.

An agitator 43 is disposed in the toner storage chamber 41 for stirring the toner therein. The agitator 43 is supported at an agitator rotary shaft 44 that extends in the width direction at the center of the toner storage chamber 41. The agitator 43 is rotated around the agitator rotary shaft 44 as the supporting point to stir the toner in the toner storage chamber 41. The toner is then discharged from an outlet 45 below the partition plate 40 toward the development chamber 42.

The feed roller 37 is disposed at the lower front portion of the development chamber 42, and rotatably supported between opposite side plates in the width direction of the frame 36. The feed roller 37 includes a feed roller shaft 46 that extends in the width direction, and a sponge roller 47, which can be formed of a conductive foam material for covering around the feed roller shaft 46.

The developer roller 38 is formed in an axial direction of the developer roller shaft 48 as the longitudinal direction, and disposed at the lower rear side of the development chamber 42 so as to be rotatably supported between the opposite side plates of the frame 36 in the width direction. The developer roller 38 is arranged such that the surface partially protrudes rearward from the frame 36 to be exposed, and contacts with the photosensitive drum 28 opposite in the longitudinal direction while having the development cartridge 26 installed in the drum cartridge 25. The developer roller 38 includes the metallic developer roller shaft 48 and a rubber roller 49, which can be formed of conductive urethane rubber or silicon rubber that contains carbon particles, and further can be formed of a surface covered with fluorine containing urethane rubber or the resin material like polyimide. The rubber roller 49 is arranged in pressure contact with the sponge roller 47 of the feed roller 37. The frame 36 below the developer roller 38 is provided with a lower film 130 that can slidably move with the developer roller 38 so as to prevent the toner spill.

The layer thickness regulation blade 39 can be formed of a metallic plate spring material having its leading end provided with a semispherical pressure rubber member 50 formed of insulating silicon rubber. The layer thickness regulation blade 39 is supported at the frame 36 above the developer roller 38, and has the lower end opposite the rubber roller 49 at the developer roller 38 at the front. The pressure rubber member 50 is in pressure contact with the rubber roller 49 under the elastic force of the layer thickness regulation blade 39.

The toner discharged to the development chamber 42 through the outlet 45 by the rotation of the agitator 43 is supplied onto the rubber roller 49 of the developer roller 38 through the rotation of the feed roller 37. At this time, positive frictional charge occurs between the sponge roller 47 of the feed roller 37 and the rubber roller 49 of the developer roller 38. The toner supplied onto the rubber roller 49 is further fed to the space between the pressure rubber member 50 of the layer thickness regulation blade 39 and the rubber roller 49 accompanied with the rotation of the developer roller 38. The resultant toner is formed into the thin layer with the constant thickness so as to be supported on the rubber roller 49.

Meanwhile, the surface of the photosensitive drum 28 is positively charged by the electrifier 29, and is subjected to the exposure through high speed scanning of the laser beam from the scanner unit 17. An electrostatic latent image based on the image data, thus, is formed.

When the positively charged toner supported on the rubber roller 49 of the developer roller 38 is brought into contact with the opposite photosensitive drum 28 accompanied with the rotation of the developer roller 38, it is supplied to the electrostatic latent image formed on the surface of the photosensitive drum 28. That is, the portion of the surface of the photosensitive drum 28 having its surface positively charged, is subjected to the laser beam exposure at the decreasing potential. The selective support of the toner allows visualization to form the toner image through a reversal phenomenon.

Thereafter, the photosensitive drum 28 and the transfer roller 30 are driven to rotate such that the sheet 3 is fed while being interposed therebetween. The toner image supported on the photosensitive drum 28 is transferred on the sheet 3.

Paper dust that may adhere to the surface of the photosensitive drum 28, caused by its contact with the sheet 3 after the transfer, may be removed by the cleaning brush 31 when it faces the surface of the rotating photosensitive drum 28.

The fixation unit 19 is disposed to the rear of the process cartridge 18, and includes a fixation frame (not shown), and a heat roller 52 and pressure roller 53 rotatably supported at the fixation frame and oppositely arranged in the vertical direction.

The heat roller 52 includes an untreated metallic pipe 64 as the cylindrical member, and has a halogen lamp 66 built therein along the axial direction. The halogen lamp 66 heats the surface of the heat roller 52 at a fixation temperature.

The pressure roller 53 includes a metallic pressure roller shaft 80 and a rubber roller 81, which may be formed of a rubber material for covering around the pressure roller shaft 80. The pressure roller 53 is elastically pressed by the untreated metallic pipe 64 of the heat roller 52 so as to be driven through rotation of the heat roller 52.

Referring to FIG. 1, the fixation portion 19 serves to heat and fix the toner transferred on the sheet 3 during its passage between the heat roller 52 and the pressure roller 53. The sheet 3 on which the toner is fixed is further fed by the carriage rollers 86 to move to an ejection path 82. The sheet 3 fed to the ejection path 82 is ejected onto a catch tray 84 formed on the upper surface of the body casing 2 by the ejection roller 83 formed above the ejection path 82.

2. Characteristic Structure

Figure 3:
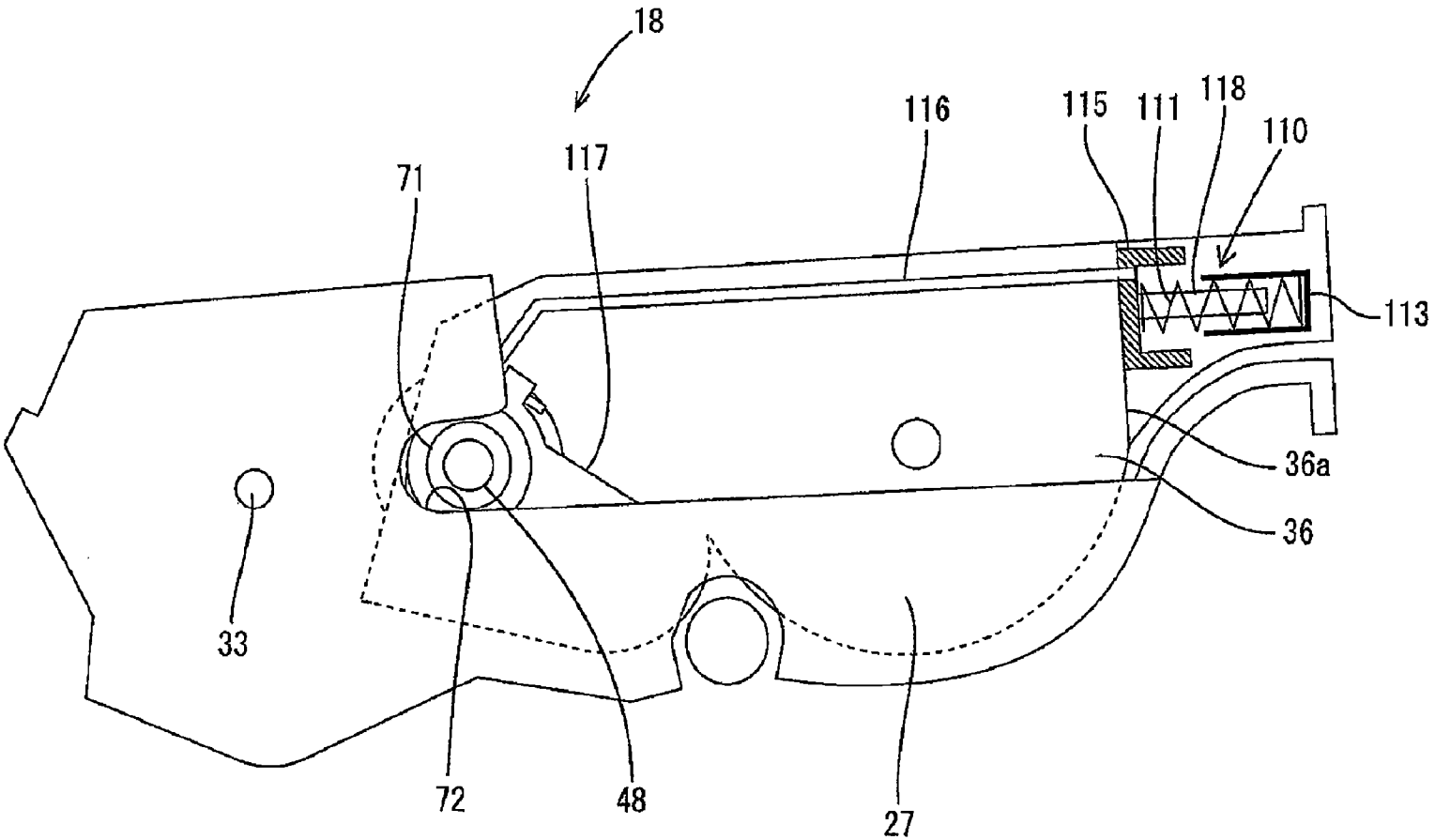
FIG. 3 is a side view schematically showing a process cartridge employed in the laser printer shown in FIG. 1.
Figure 4:
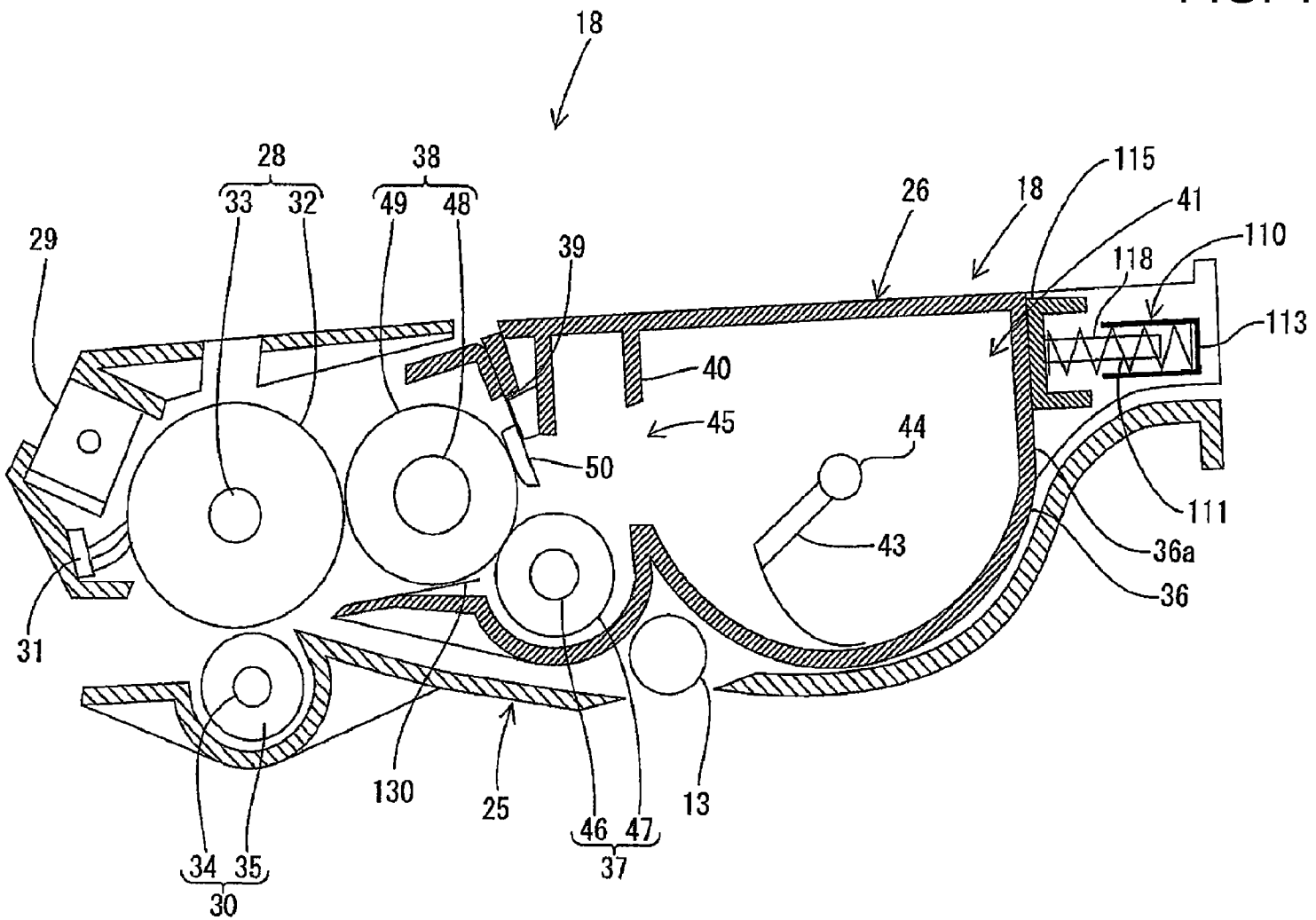
FIG. 4 is a sectional side elevation of the process cartridge shown in FIG. 3.
Figure 5:
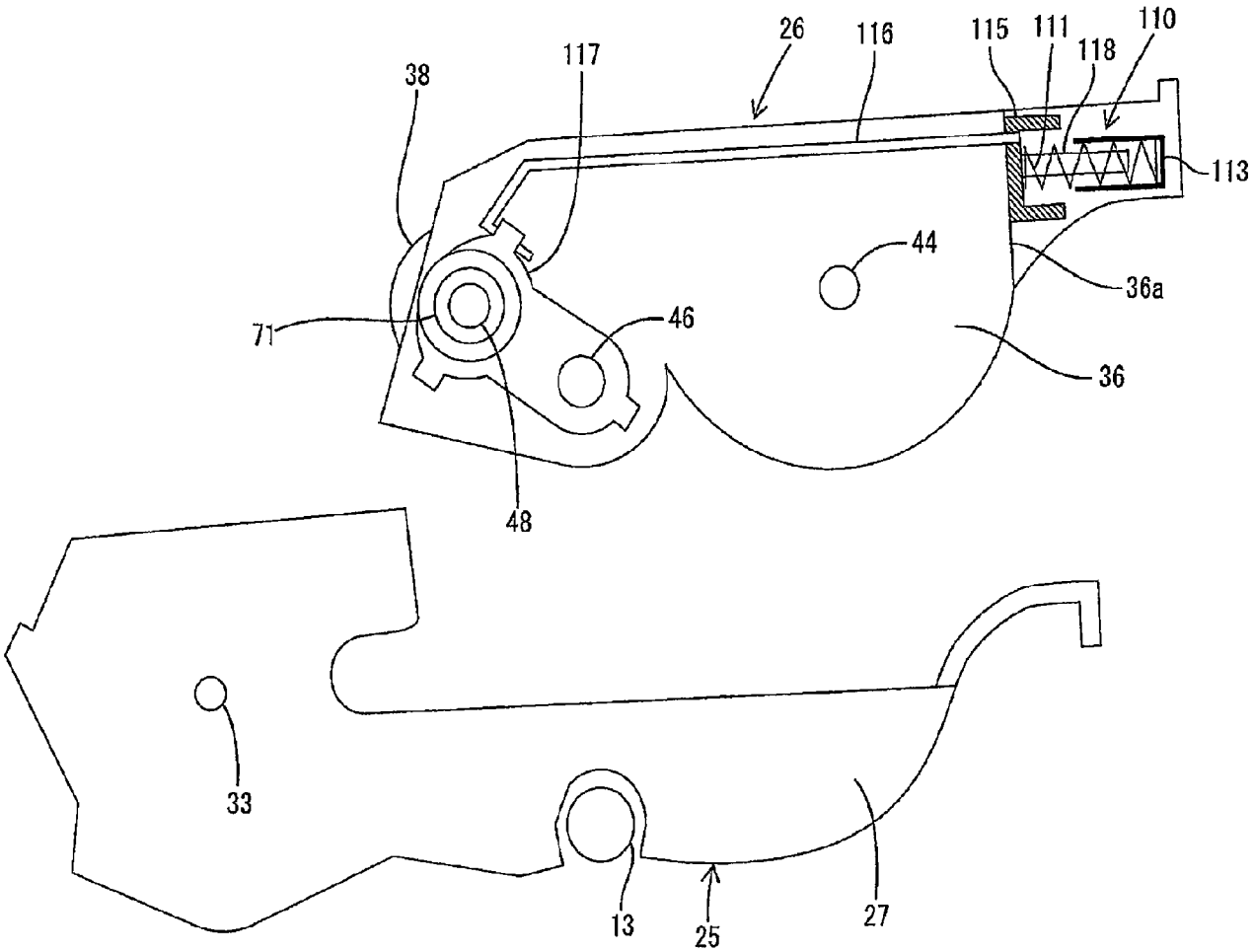
FIG. 5 is a side view of a state where a development cartridge is removed from the drum cartridge as seen from the side.
Figure 6:
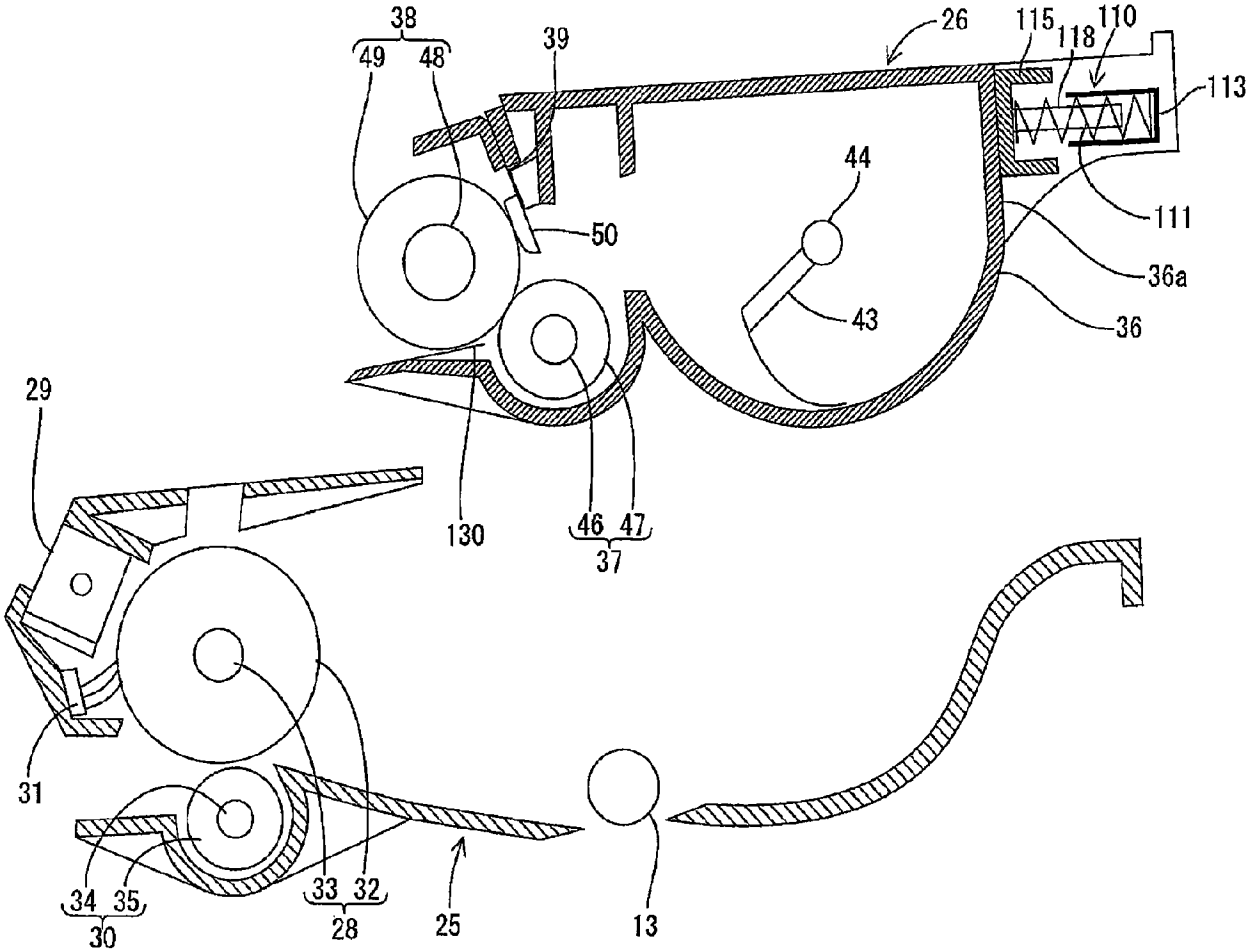
FIG. 6 is a sectional side elevation of the state shown in FIG. 5.
Figure 7:
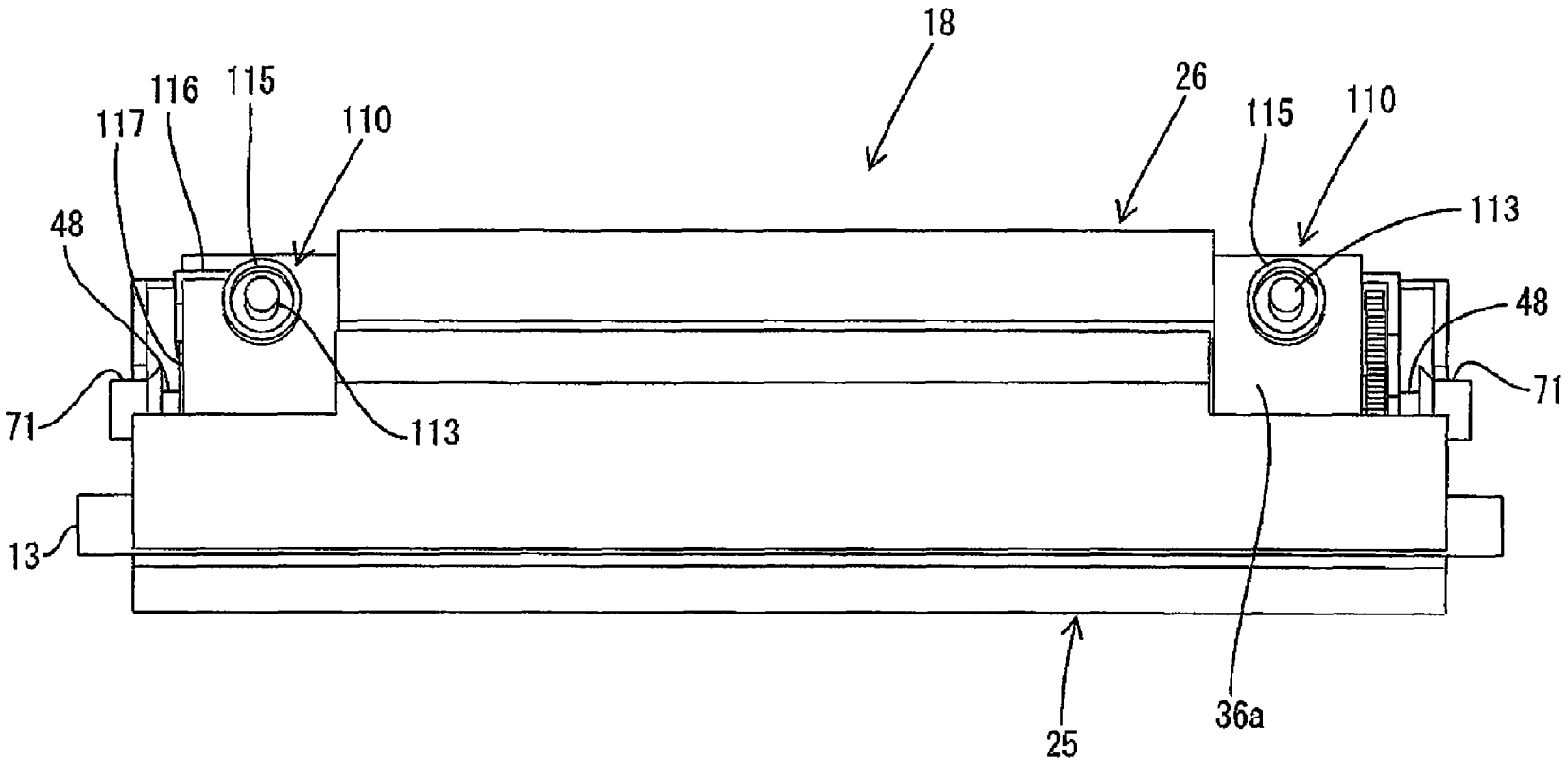
FIG. 7 is a front view of the process cartridge shown in FIG. 3 seen from the front.
Figure 8:
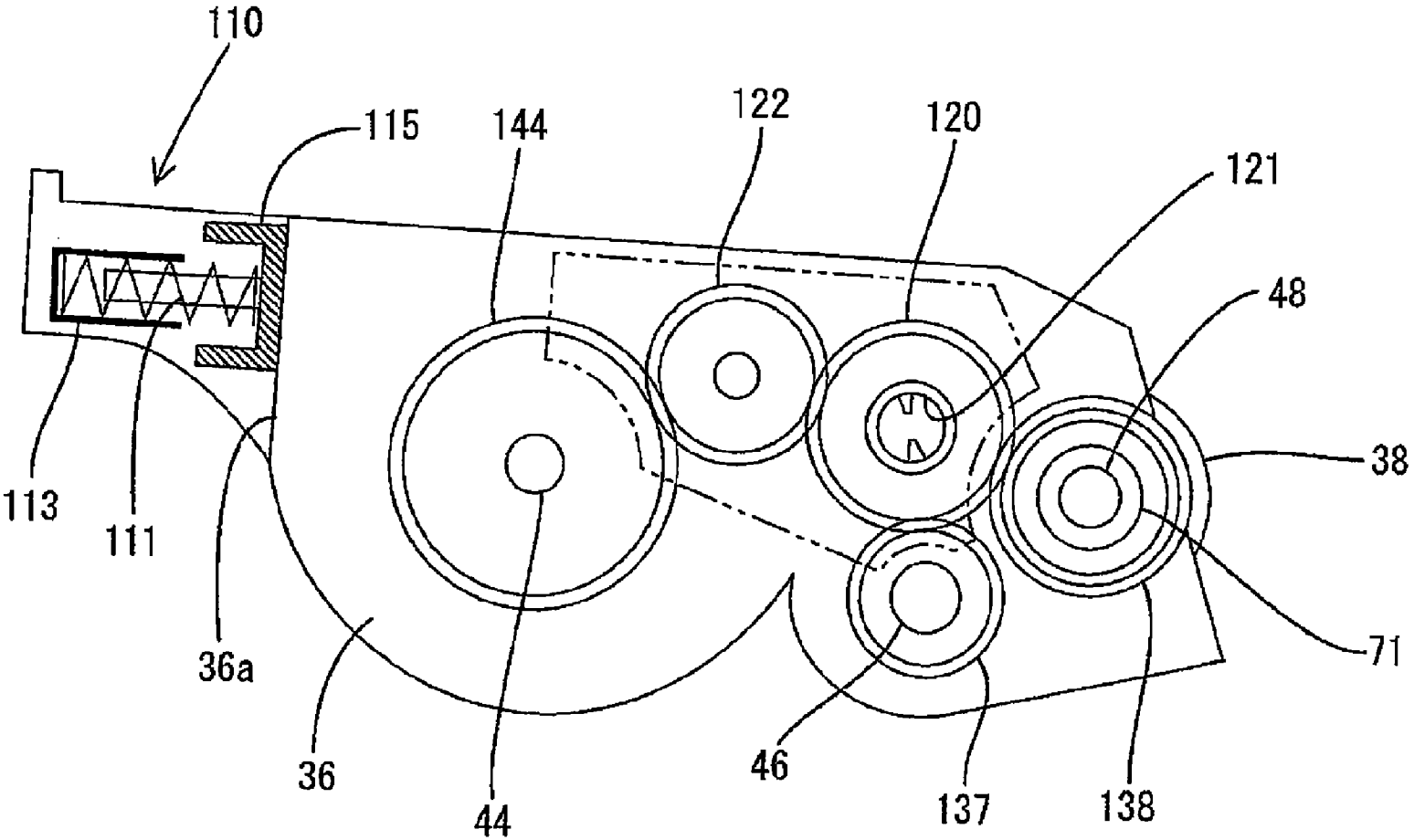
FIG. 8 is a side view of the development cartridge seen from the side opposite the one in FIG. 5.

FIG. 3 is a side view schematically showing the process cartridge 18. FIG. 4 is a sectional side elevation of the view shown in FIG. 3. FIG. 5 is a side view showing the state where the development cartridge 26 is removed from the drum cartridge 25. FIG. 6 is a sectional side elevation of the view shown in FIG. 5. FIG. 7 is a front view of the process cartridge 18 seen from the front. FIG. 8 is a side view schematically showing the development cartridge 26 as seen from the side opposite the one shown in FIG. 5.

The development cartridge 26 corresponds to a cartridge according to one aspect of the present invention. It is structured to be set in a main body 1 a of the laser printer 1. Referring to FIGS. 3 and 4, it includes the developer roller 38 opposite the photosensitive drum 28, and the frame 36 that stores the developer roller 38, and is installed in the drum cartridge 25 to form the process cartridge 18 together therewith. Rollers 71 provided at both longitudinal ends of the developer roller shaft 48 of the developer roller 38 are fit in a guide groove 72 formed in the drum cartridge 25 such that the development cartridge 26 is movably installed in the drum cartridge 25 forward and backward. The development cartridge 26 is detachably installed in the drum cartridge 25 as shown in FIGS. 5 and 6. The "main body" in the invention represents the portion to which the "cartridge" in the image forming apparatus as a whole is set.

Figure 2:
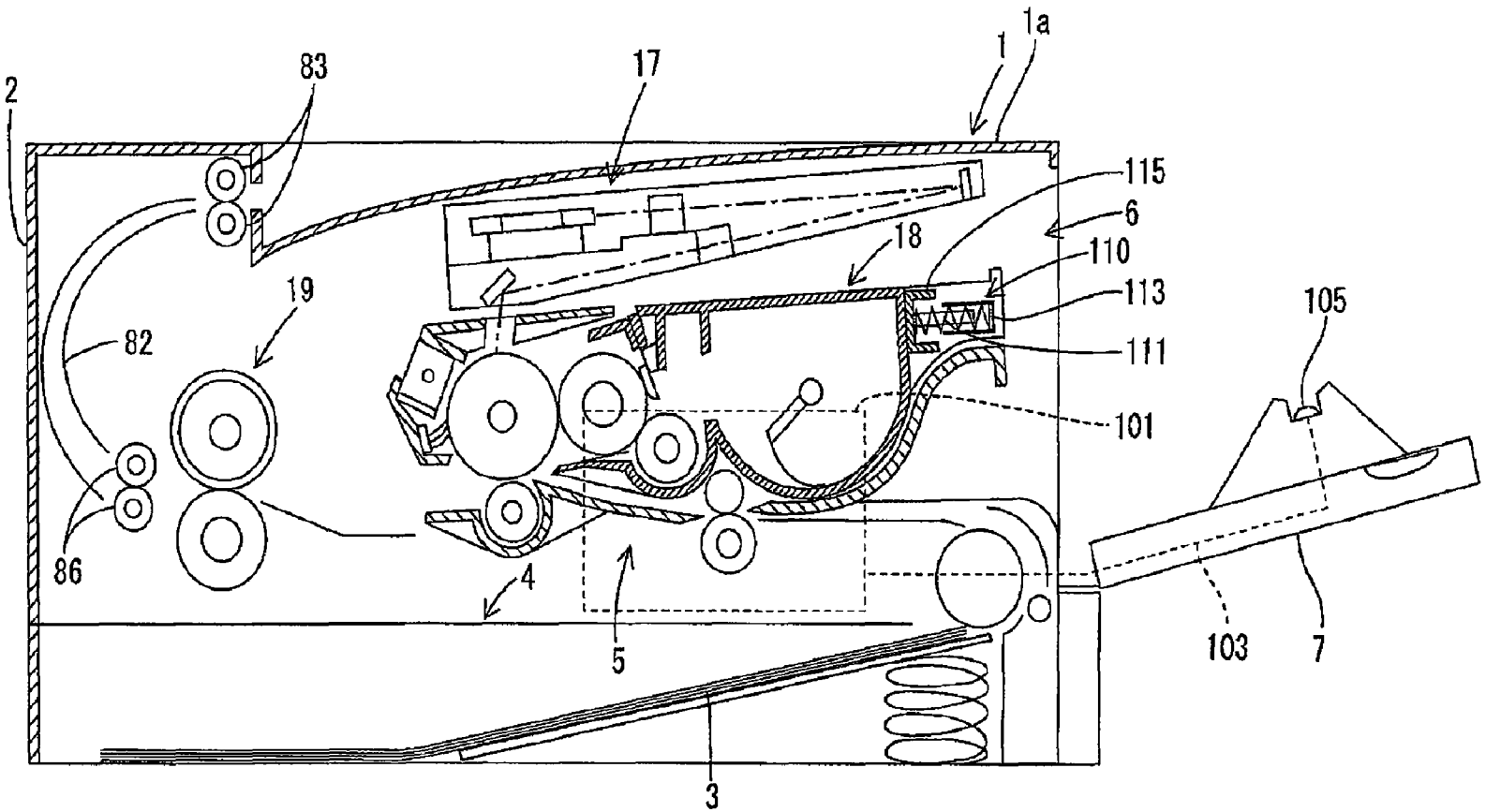
FIG. 2 is a view of the laser printer shown in FIG. 1 having its front cover opened.

The development cartridge 26 includes the developer roller 38 that is structured to be urged to the photosensitive drum 28 by pressing the frame 36 against the photosensitive drum 28 under the elastic force of the spring member 111. Furthermore, voltage is applied to the development cartridge 26 from a power supply circuit 101 (corresponding to the power supply unit) in the main body 1*a* of the laser printer 1 via the spring member 111. The power supply circuit 101 is a high voltage power supply circuit based on the commercial power supply for generating predetermined high voltage. FIGS. 1 and 2 shows the position of the structure of the power supply circuit 101 as dashed lines. However, it is to be understood that the arrangement and configuration of the power supply circuit 101 are not limited to the one as described above and as shown in FIGS. 1 and 2.

More specifically, the development cartridge 26 can include cartridge electrode 110 to which voltage is transferred from a main body electrode 105, which is connected to the power supply circuit 101 in the main body 1*a*. The cartridge electrode 110 is attached to a wall 36*a* opposite the side at which the developer roller 38 is provided in the frame 36. It includes a conductive contact member 113 corresponding to the contact portion that contacts the main body electrode 105. This configuration can also include a conductive spring member 111, as the urging member, that urges the contact member 113 and the frame 36 in the opposite direction away from each other. Also, a guide member 118 is provided inside the spring member 111 to reduce the tendency of the spring member 111 to tilt.

The laser printer 1 includes a front cover 7 (corresponding to the cover member) that, when opened, defines opening 6. In this aspect of the invention, the main body electrode 105 is attached to the front cover 7. The cartridge electrode 110 is structured to be pressed by the main body electrode 105 when the front cover 7 is closed as shown in FIG. 1.

When the cartridge electrode 110 is positioned as shown in FIG. 1, the spring member 111 contracts from its original position. In the aforementioned usage state, the contact member 113 is urged to the main body electrode 105, and the frame 36 is urged to the rear of the main body 1*a* toward the photosensitive drum 28 by the elastic deformation of the spring member 111.

In the installed state where the front cover 7 is closed, the front cover 7 is placed at a predetermined position such that the distance between the main body electrode 105 and the frame 36 is narrowed. Accordingly, the spring member 111 contracts from the original position to urge the contact member 113 to the main body electrode 105. Further in the installed state, the contact member 113 is positioned under pressure of the main body electrode 105. This allows the cartridge electrode 110 to generate the urging force that urges the development cartridge 26 rearward using the elastic return force of the spring member 111 that has been deformed under the pressure.

In the usage state where the process cartridge is installed in the laser printer 1 (see FIG. 1), the cartridge electrode 110 is structured to generate the urging force that urges the developer roller 38 to the photosensitive drum 28. This allows the developer roller 38 to be positioned with high accuracy in the usage state, thus realizing excellent development. The term "usage state" in the invention represents the state where the image forming is performed.

Referring to FIGS. 3 and 5, the cartridge electrode 110 (also referred to as the developer electrode) is electrically coupled with the developer roller shaft 48 of the developer roller 38. More specifically, the cartridge electrode 110 contacts a conductive base member 115 that is pressed by the spring member 111 and the conductive contact member 113 and the conductive spring member 111. The base member 115 is connected to a thin long conductive member 116 (that can be formed of a wire or a long cut sheet metal), and connected to a conductive bearing member 117 that supports the developer roller shaft 48. The bearing member 117 rotatably supports the developer roller shaft 48 to maintain electrical coupling therewith. The aforementioned structure allows power, or a bias voltage, from the main body electrode 105 to be applied to the developer roller shaft 48 such that bias voltage is applied to the developer roller shaft 48.

In the aforementioned structure, the cartridge electrode 110 is electrically coupled with electric parts other than the developer roller 38. Specifically, referring to FIGS. 3 and 5, the bearing member 117 rotatably supports the feed roller shaft 46 of the feed roller 37 such that the electrical coupling between the bearing member 117 and the feed roller shaft 46 is maintained. Accordingly, power supply to the developer roller 38 and stable positioning thereof to the development position may be realized as well as application of the voltage at the same potential to a part (feed roller 37 in this case) other than the developer roller 38. The "part" other than the developer roller 38 may be the part that requires the power supply. It may be an electric part other than the feed roller 37, for example, the layer thickness regulation blade 39, the lower film 130 and the like.

Referring to FIG. 7, the terminals at cartridge side 110 are provided at both ends of the development cartridge 26. One of those terminals at cartridge side 110 serves to apply voltage to the developer roller 38 and the member to be controlled at the same potential (feed roller 37 in this case) as shown in FIGS. 3 to 5.

In the aspect, only one of the terminals at cartridge side 110 serves to apply the voltage to the developer roller 38 and the another part (feed roller 37 in this case), and the other terminal at cartridge side 110 is not used for applying the voltage. However, the other terminal at cartridge side 110 may be structured to apply the voltage to a different part (for example, the part to which the voltage at the level different from the one applied to the developer roller 38 is applied).

In the aspect, the specific structure for power supply to the lower film 130 is not shown in the drawing. The voltage at the same potential as the one applied to the developer roller 38 may be applied by the structure to electrically couple one of the terminals at cartridge side 110 with the lower film 130. The voltage at the potential different from the one applied to the developer roller 38 may be applied to the lower film 130 by the structure to electrically couple the other terminal at cartridge side 110 with the lower film 130.

Referring to FIG. 7, in this aspect, the pair of left and right cartridge electrodes 110 are provided, each of which is provided with the spring member 111 as the urging member. This aids in the stable positioning of the development cartridge 26.

In this aspect, the pair of left and right terminals at cartridge side 110 are provided with the corresponding left and right spring members 111, and one of those terminals at cartridge side 110 performs power supply. However, both terminals may be structured to be used for the power supply.

The developer roller 38, the feed roller 37, and the agitator rotary shaft 44 rotate in association with a rotation of a drive gear 120, which is driven by a main motor (not shown). Specifically, a first gear 138 connected to the developer roller shaft 48 of the developer roller 38, and a second gear 137 connected to the feed roller shaft 46 of the feed roller 37 are provided. The drive gear 120 includes a coupling portion 121 to transfer a driving force originating from the main motor. When the first and the second gears 138 and 137 receive the driving force from the drive gear 120 through the gear transmission, the developer roller 38 and the feed roller 37 rotate. A third gear 144 is connected to the agitator rotary shaft 44 which rotates upon reception of the driving force from the drive gear 120 via an intermediate gear 122.

In this aspect, the voltage is applied from the power supply circuit 101 (power supply unit) set in the laser printer 1 via the conductive spring member 111 as the urging member. Accordingly, in the laser printer 1, the urging unit performs the urging function to urge the developer roller 38 to the photosensitive drum 28, and the terminal function to supply power to the developer roller 38.

The development cartridge 26 is provided with the cartridge electrode 110 to which the voltage is applied from the main body electrode 105 connected to the power supply circuit 101 in the main body 1*a*. The conductive spring member 111, attached to the cartridge electrode 110, can be defined as the urging member. The urging unit is formed of the spring member 111 and the contact member 113. The aforementioned structure makes it possible to allow the urging unit to easily perform both an urging function and power supply function.

The cartridge electrode 110 of the development cartridge 26 is pressed by the main body electrode 105 to generate the urging force to urge the developer roller 38 to the photosensitive drum 28. The aforementioned structure makes it possible to allow the cartridge electrode 110 to perform the function for supplying power from the main body to the developer roller 38, and the function to stably bring the developer roller 38 to the development position by transferring the urging force to the developer roller 38. Both functions as described above may be realized in a preferred way without complicating the cartridge structure.

In the usage state where the development cartridge 26 is set in the laser printer 1, the cartridge electrode 110 is structured to generate the urging force to urge the developer roller 38 to the photosensitive drum 28. Accordingly, the developer roller 38 may be positioned with highly accuracy in the usage state, resulting in excellent development.

The cartridge electrode 110 is attached to the wall 36*a* of the frame 36, which is opposite the side at which the developer roller 38 is attached, and further is electrically coupled with the developer roller shaft 48 (shaft) of the developer roller 38. It is structured to generate the urging force to urge the frame 36 toward the photosensitive drum 28 under pressure of the main body electrode 105.

The front cover 7 is formed in one side of the laser printer 1, and when opened, defines the opening 6. The front cover 7 is further provided with the main body electrode 105. The cartridge electrode 110 is structured to be pressed by the main body electrode 105 when the front cover 7 is closed. In the aforementioned structure, when the front cover 7 provided with the main body electrode 105 is opened, the main body electrode 105 moves to a restored position from the attachment/removal path of the development cartridge 26. Accordingly, the development cartridge 26 (that is, the process cartridge 18) may be easily attached or removed without interference with the main body electrode 105.

Another aspect of the present invention will be described referring to FIGS. 9 and 10.

Figure 9:
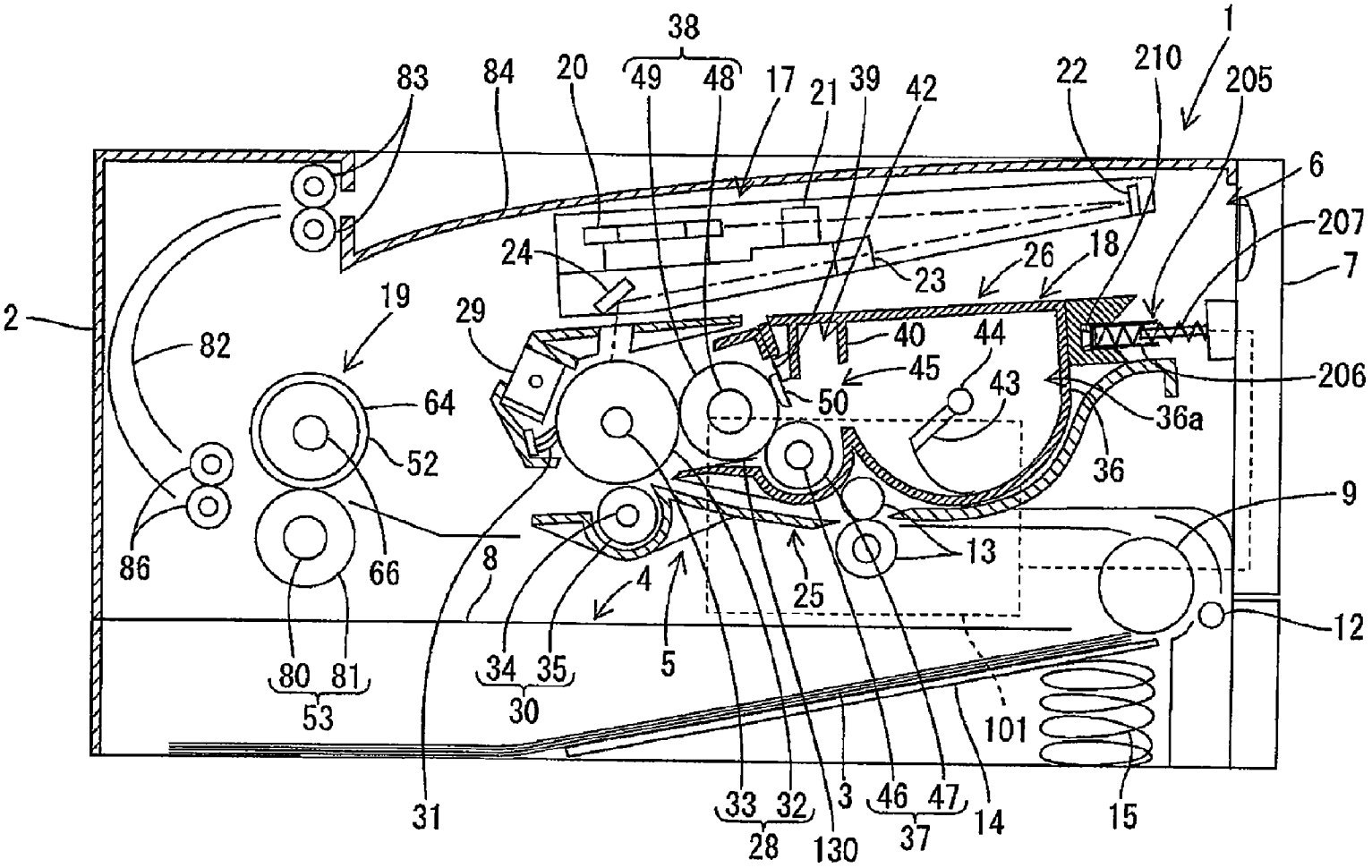
FIG. 9 is a sectional side elevation schematically showing a laser printer according to another aspect of the present invention.
Figure 10:
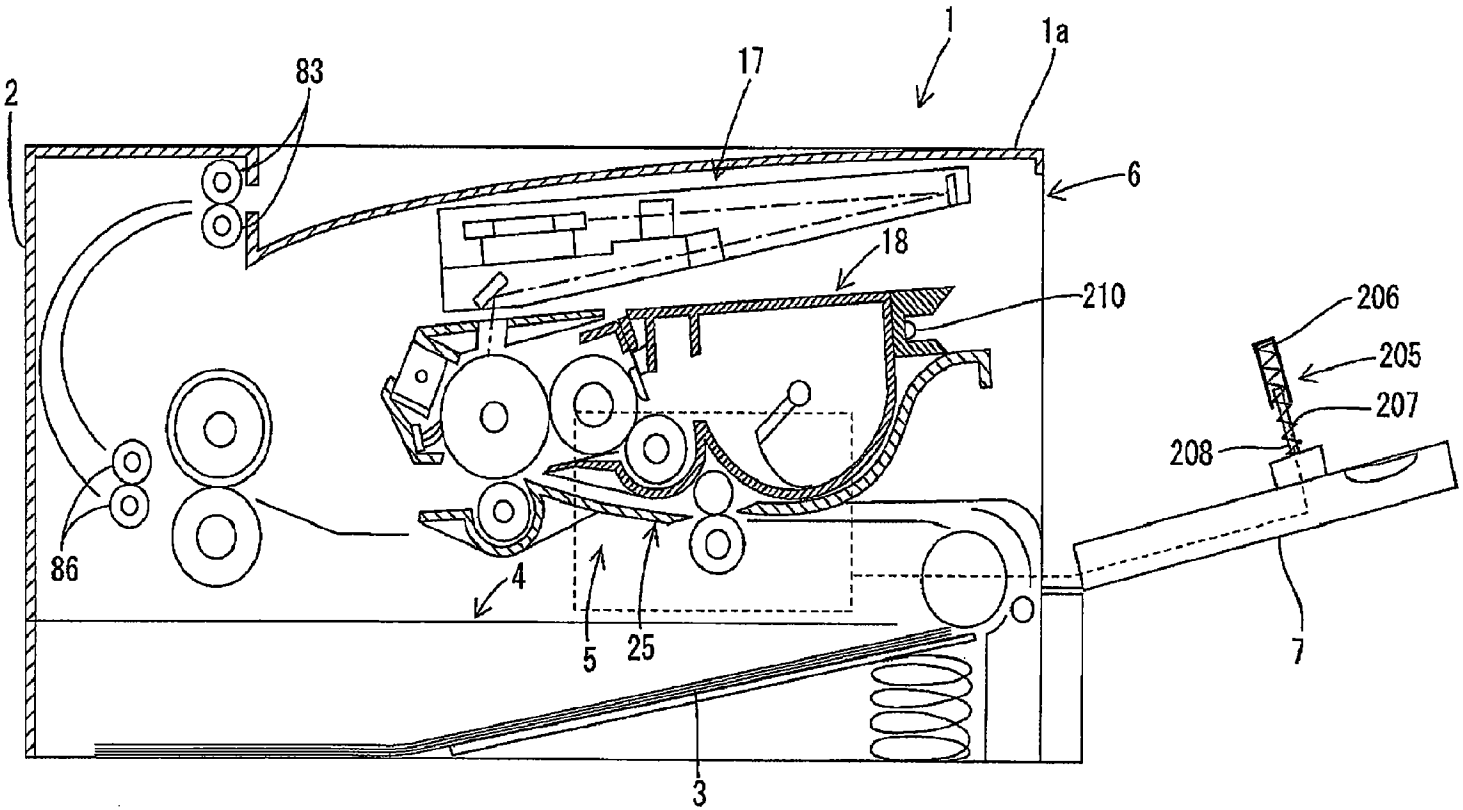
FIG. 10 is a view of the laser printer shown in FIG. 9 having the front cover opened.

FIG. 9 is a sectional side elevation conceptually showing a laser printer 1 according to another aspect of the present invention. FIG. 10 is a view of the laser printer 1 shown in FIG. 9 having the front cover 7 opened. The structure according to this aspect is the same as that of the previous aspect except that the structure of the terminals at cartridge side and main body side differ, and thus only the differences will be described below.

According to this aspect, a terminal at cartridge side 210 attached to the development cartridge 26 is pressed by a main body electrode 205 of the main body 1*a* such that the urging force (that is, the force that pushes the frame 36 entirely toward the photosensitive drum 28) is generated. In this case, as the main body electrode 205 of the main body 1*a* includes the urging unit, and the cartridge electrode 210 requires no urging unit. This makes it possible to simplify the structure of the process cartridge as described below.

Referring to FIG. 9, the development cartridge 26 set in the laser printer 1 according to this aspect of the present invention is structured as a cartridge provided with the developer roller 38, similar to the previous aspect. The development cartridge 26 is structured to be urged to the photosensitive drum 28 under the elastic force of a conductive spring member 207, and receives application of the voltage from the power supply circuit 101 (power supply unit) via the spring member 207. In this aspect, the urging unit is formed of the spring member 207 and a contact member 206.

The development cartridge 26 includes the cartridge electrode 210 to which the voltage is applied from the main body electrode 205 connected to the power supply circuit 101 in the main body 1*a*. The cartridge electrode 210 which is formed of a conductive metallic member in contact with the main body electrode 205 is attached to the wall 36*a* opposite the side where the developer roller 38 is provided in the frame 36. The cartridge electrode 210 is connected to the conductive member similar to the previous aspect (see the reference numeral 116 in FIG. 5), and electrically coupled with the bearing member (see the reference numeral 117 in FIG. 5) that supports the developer roller shaft 48 of the developer roller 38. Power from the main body electrode 205 is supplied to the developer roller shaft 48 via the cartridge electrode 210, the conductive member (see the reference numeral 116 in FIG. 5), and the bearing member (see the reference numeral 117 in FIG. 5) such that the bias voltage is applied to the developer roller shaft 48.

Similar to the previous aspect, the laser printer 1 includes front cover 7, and when opened, defines opening 6. The main body electrode 205, attached to the front cover 7, includes an elastically deformable conductive spring member 207 and a conductive contact member 206 urged by the spring member 207. In response to the pressure applied to the contact member 206 toward the front cover 7, the spring member 207 contracts. The elastic return force of the spring member 207 functions in urging the contact member 206. A spring guide member 208 is provided inside the spring member 207 to reduce the tendency of spring member 207 to tilt.

When the front cover 7 is closed as shown in FIG. 9, the main body electrode 205 is pressed by the cartridge electrode 210 to contract the spring member 207. The contact member 206 is urged in accordance with the elastic return force so as to press the cartridge electrode 210.

In the installed state where the front cover 7 is closed, it is set at a predetermined position, and the distance between the front cover 7 and the contact member 206 is narrowed. Then, the spring member 207 contracts from its original position such that the contact member 206 is urged to the cartridge electrode 210. Upon reception of the urging force, the cartridge electrode 210 generates the urging force that urges the entire frame 36 of the development cartridge 26 rearward.

In this aspect, in the usage state (shown in FIG. 9) in which the process cartridge 18 is set in the laser printer 1, the cartridge electrode 210 is structured to generate the urging force that urges the developer roller 38 toward the photosensitive drum 28. The developer roller 38, thus, may be positioned with high accuracy during the usage to realize excellent development.

Another aspect of the present invention will be described referring to FIGS. 11 to 16.

Figure 11:
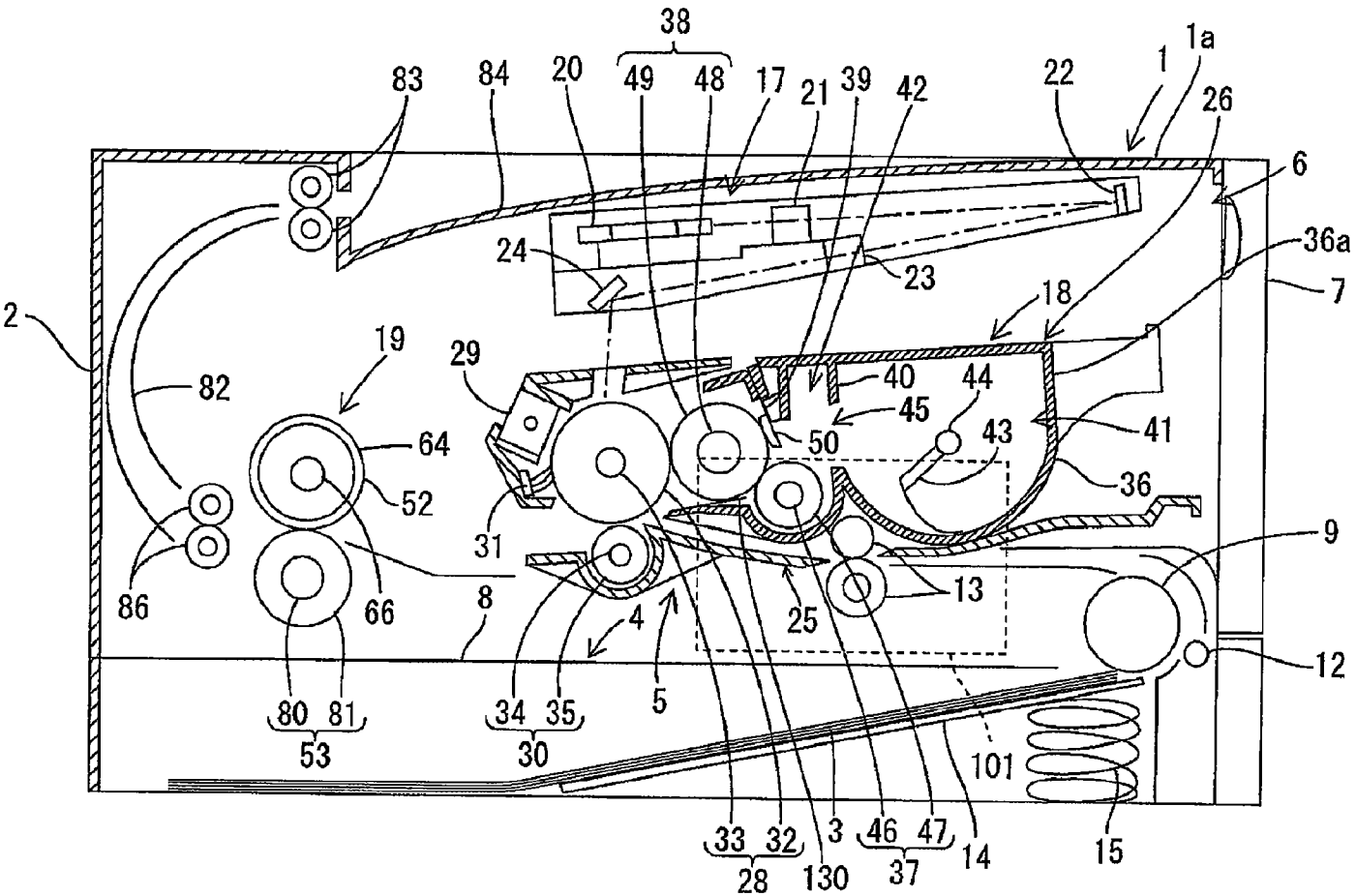
FIG. 11 is a sectional side elevation conceptually showing a laser printer according to another aspect of the present invention.
Figure 12:
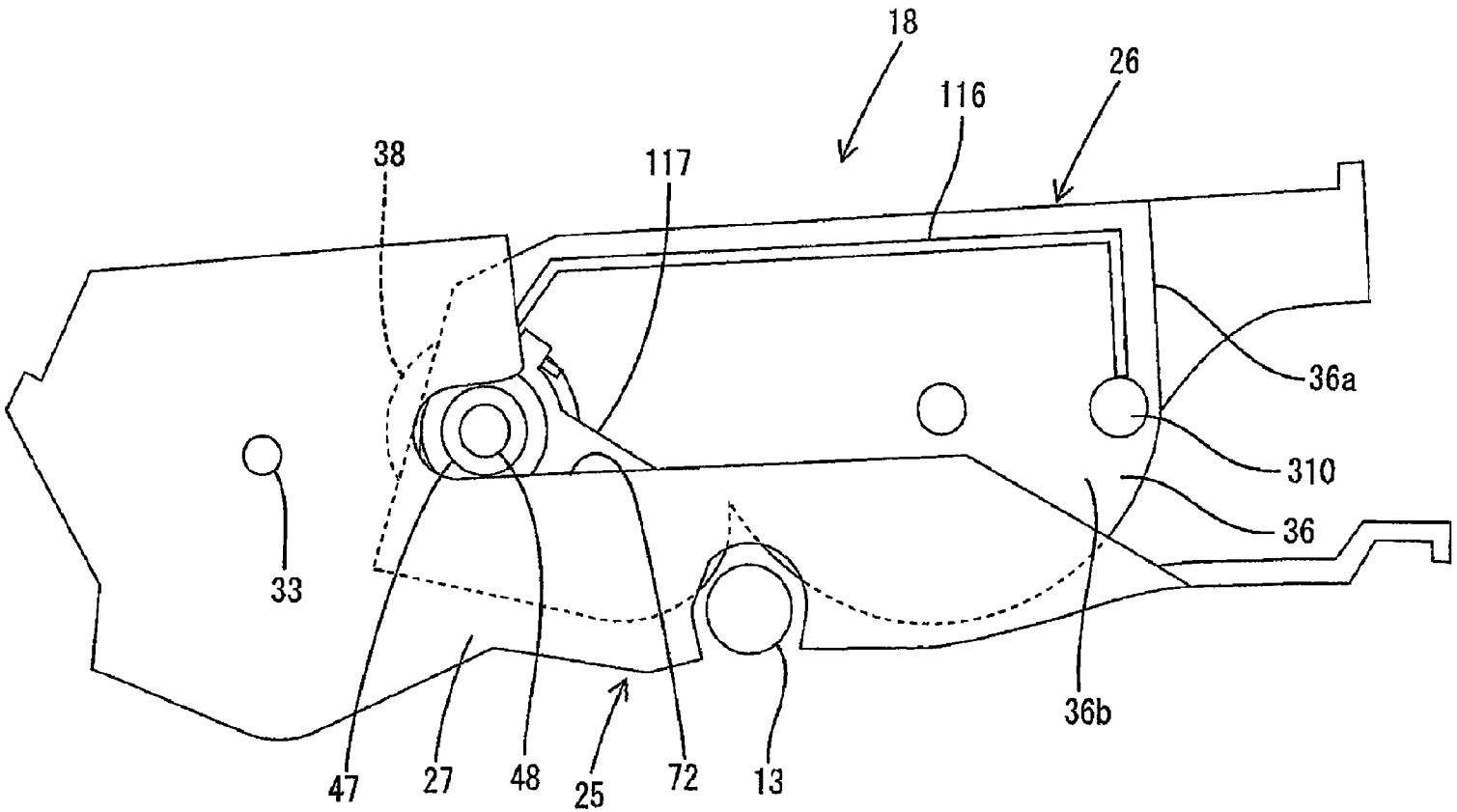
FIG. 12 is a side view conceptually showing the process cartridge employed in the laser printer.
Figure 13:
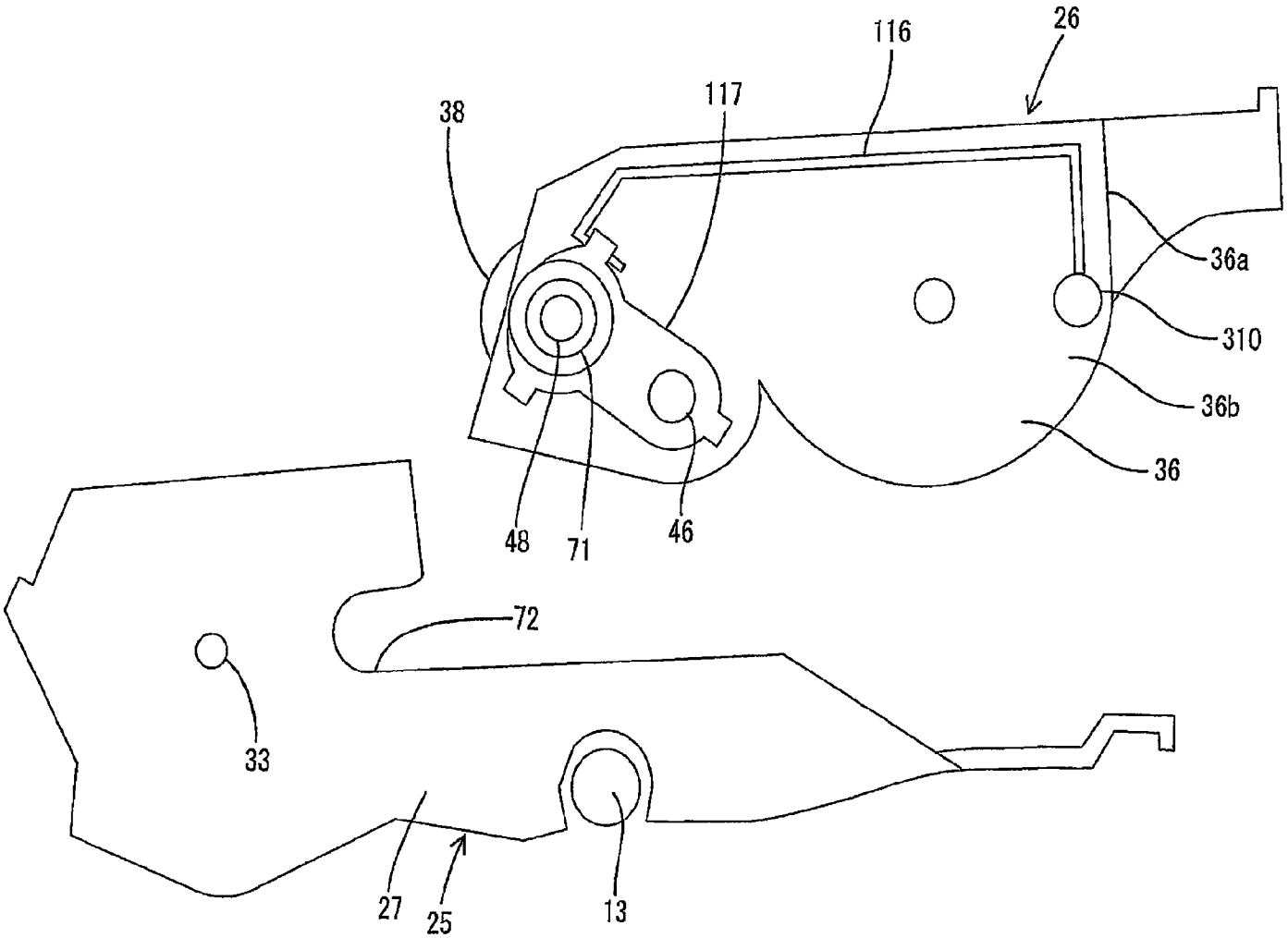
FIG. 13 is a side view of the process cartridge shown in FIG. 12 having the development cartridge removed from the drum cartridge.
Figure 14:
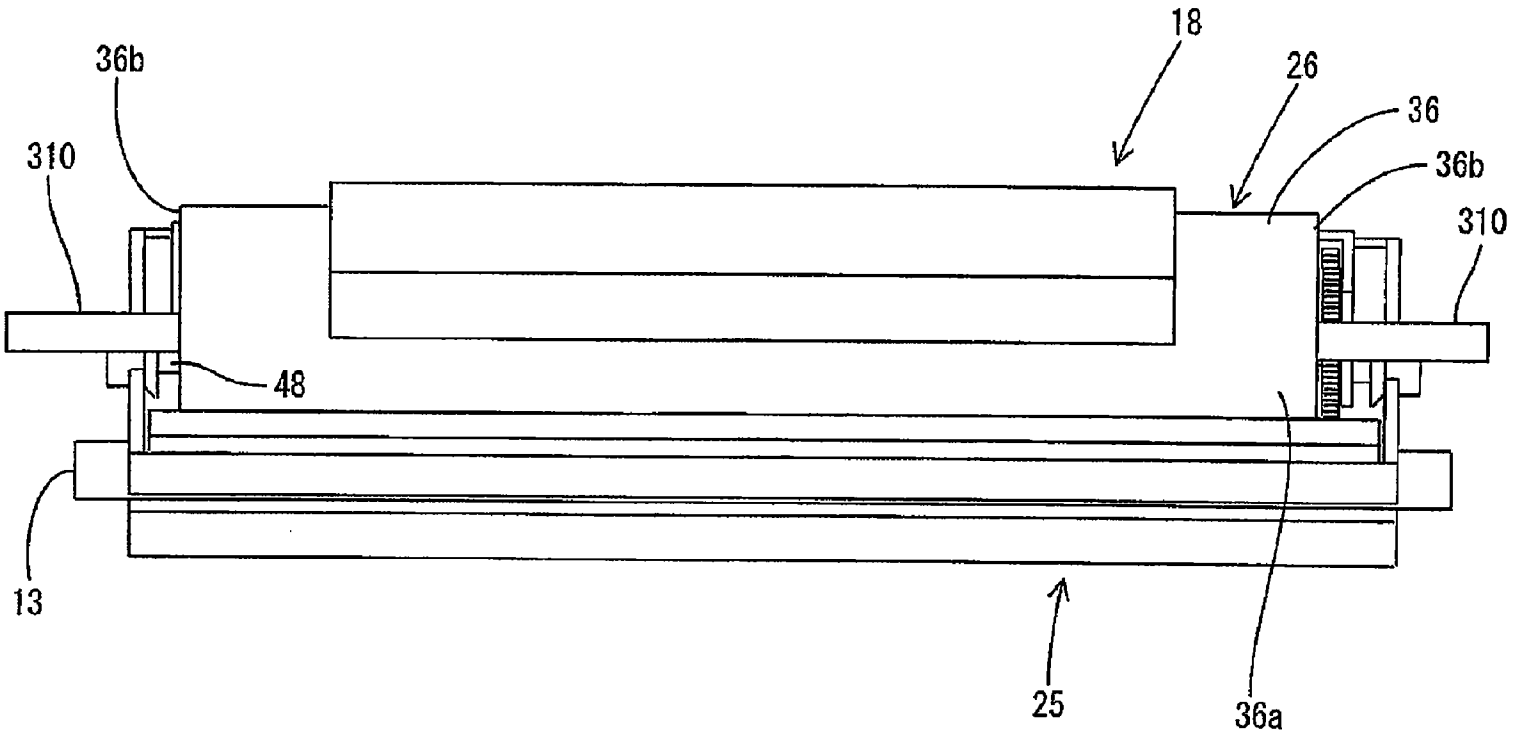
FIG. 14 is a front view of the process cartridge shown in FIG. 12 as seen from the front.
Figure 15:
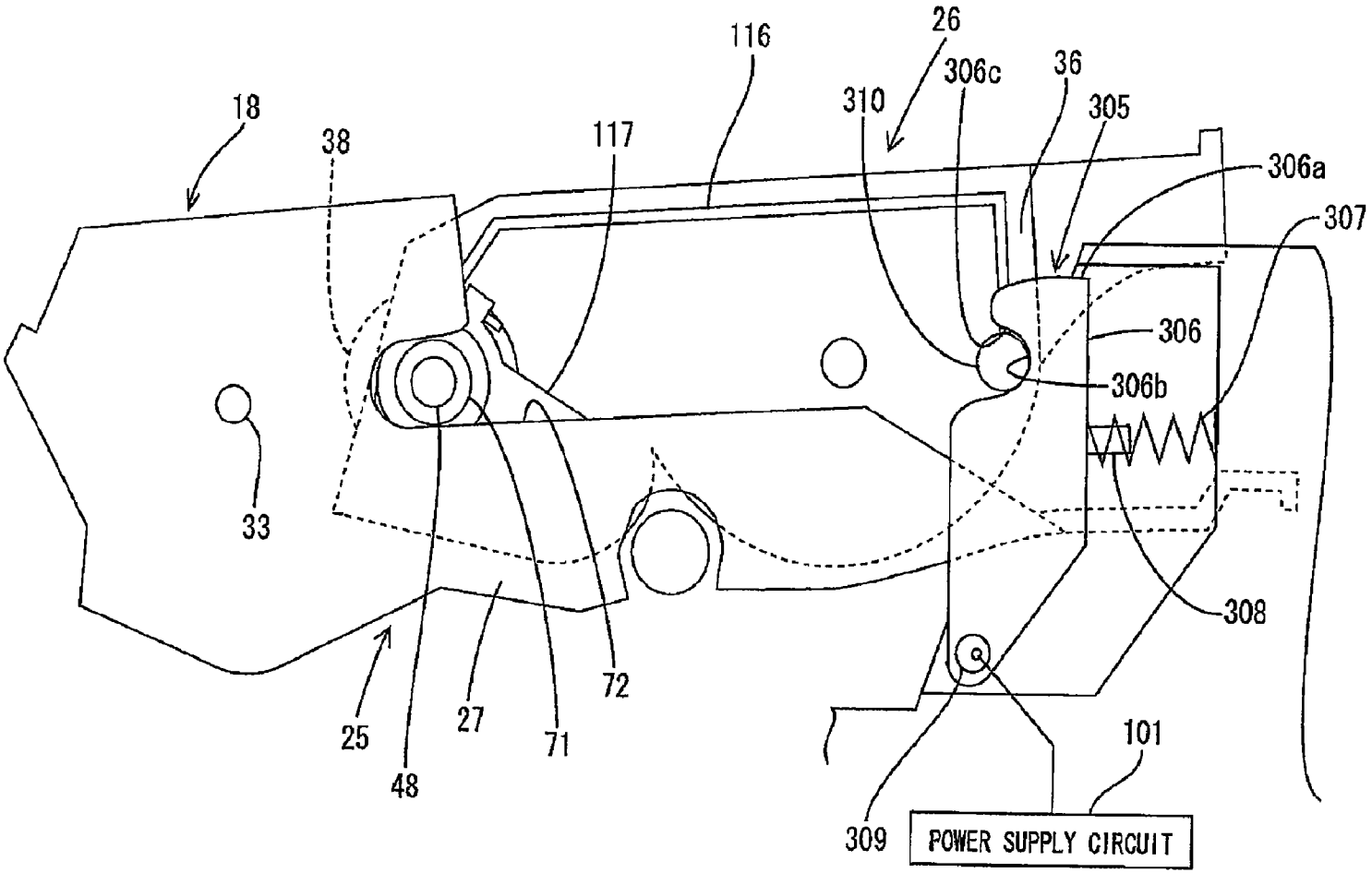
FIG. 15 is an explanatory view conceptually showing the process cartridge shown in FIG. 12 set in the main body.
Figure 16:
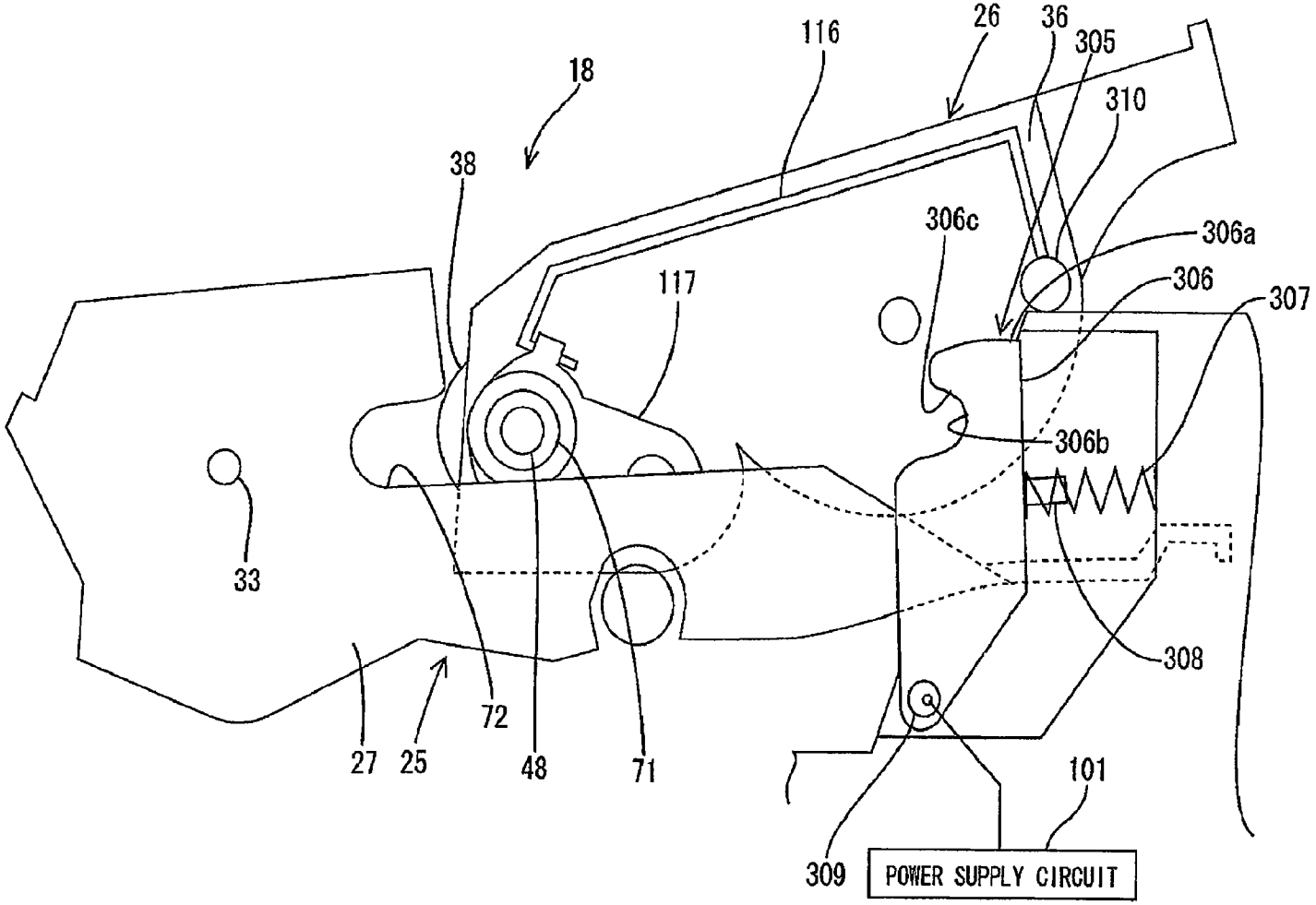
FIG. 16 is an explanatory view of the state shown in FIG. 15 having the development cartridge disengaged.

FIG. 11 is a sectional side elevation that conceptually shows the laser printer 1 according to another aspect of the present invention. FIG. 12 is a side view conceptually showing the process cartridge 18 set in the laser printer 1. FIG. 13 is a view of the process cartridge 18 in the state where the development cartridge 26 is removed from the drum cartridge 25. FIG. 14 is a front view of the process cartridge 18 shown in FIG. 12 as seen from the front. FIG. 15 is an explanatory view conceptually showing the process cartridge 18 in FIG. 12 set in the main body 1*a*. FIG. 16 is an explanatory view showing disengagement of the development cartridge 26 from the state shown in FIG. 15. The structure of this aspect is the same as that of the previous aspects except that the structures of the terminals at cartridge side and the main body side, and the drum cartridge 25 differ, thus only the differences will be described below Referring to FIG. 11, the development cartridge 26 including the developer roller 38 is formed as the cartridge similar to the previous aspects of the present invention. It forms the process cartridge 18 together with the drum cartridge 25 as shown in FIG. 12, and is detachably installed in the drum cartridge 25.

In this aspect, the cartridge electrode is not attached to the wall 36*a* at the front of the frame 36 shown in FIG. 11. Rather, the cartridge electrode 310 is attached to a side wall 36*b* of the frame 36 as shown in FIGS. 12 and 14. Specifically, in the width direction (parallel to the axial direction of the developer roller 38), protrusions that extend outward from side walls 36*b* and 36*b* of the frame 36 are formed as terminals at cartridge side 310. The cartridge electrode 310 can be formed of a conductive resin or a metallic material, and connected to the conductive member 116 as shown in FIGS. 12 and 13. The connection of the conductive member 116 with the bearing member 117, and the support of the developer roller shaft 48 at the bearing member 117 are the same as those described in the previous aspects. The cartridge electrode 310 is electrically coupled with the developer roller shaft 48. In this configuration, the cartridge electrode 310 is provided adjacent to both side walls of the frame 36. This makes it possible to simplify the wiring for applying the voltage to the developer roller 38.

Further, conductive member 116 is disposed on the same plane (side wall 36*b* of the frame 36) from the side wall 36*b* to the wall 36*a*, thus it can be formed only by punching a plate without requiring bending work.

The unit for urging the developer roller 38 to the photosensitive drum 28 is provided further adjacent to the end. The restoring force generated upon lifting of the developer roller 38 from the photosensitive drum 28 further stabilizes the developer roller 38.

In the development cartridge 26 according to this aspect, the developer roller 38 is urged by the urging force from the main body electrode 305 to the photosensitive drum 28 as shown in FIG. 15. The voltage from the power supply circuit 101 (power supply unit) set in the main body 1*a* of the laser printer 1 is applied to the development cartridge 26 via the main body electrode 305. In this aspect, the main body electrode 305 is provided with the urging unit, which is attached to the inner wall opposite the side of the development cartridge 26 in the main body 1*a*. A conductive swing member 306 is supported at the wall of the main body 1*a* so as to swing around the rotary shaft 309. The conductive spring member 307 is connected to the swing member 306 such that its predetermined position is urged to the photosensitive drum 28. In the aspect, the urging unit is formed of the spring member 307 and the swing member 306. In the installed state shown in FIG. 15, the cartridge electrode 310 presses the end of the swing member 306 forward (opposite the side at which the rotary shaft 309 is attached). The spring member 307 contracts from its original position as shown in FIG. 16. In the installed state, the end of the swing member 306 is urged rearward under the elastic return force of the spring member 307, and the cartridge electrode 310 is further urged rearward (to the photosensitive drum 28). Accordingly, the frame 36 of the development cartridge 26 is entirely urged to the photosensitive drum 28 such that the developer roller 38 is stably positioned.

Referring to FIG. 16, the laser printer 1 allows attachment and removal of only the development cartridge 26 from the state where the process cartridge 18 is set (the state shown in FIG. 15). In other words, the development cartridge 26 may be installed to or removed from the drum cartridge 25 set in the main body 1*a*. The development cartridge 26 may be attached or removed integrally with the drum cartridge 25.

In the state where the process cartridge 18 or the development cartridge 26 is removed, the spring member 307 is held in the original position as shown in FIG. 16. When the development cartridge 26 is installed in this state, the cartridge electrode 310 is guided by the top end 306*a* of the swing member 306 to move rearward of the swing member 306. The cartridge electrode 310 is then engaged with an engagement portion 306*b* as shown in FIG. 15. In the engagement state, the spring member 307 contracts from its original position to transfer an urging force on the main body electrode 305. Meanwhile, when the development cartridge 26 in the state shown in FIG. 15 is removed, the front end of the development cartridge 26 is lifted up such that the cartridge electrode 310 is guided by a taper surface 306*c* above the engagement portion 306*b*. It is, then, disengaged as shown in FIG. 16. The process cartridge 18 may be removed in the same manner as described above (that is, the drum cartridge 25 and the development cartridge 26 can be integrally removed). The front end of the process cartridge 18 can be lifted up such that the cartridge electrode 310 is guided by the taper surface 306*c* above the engagement portion 306*b*, and disengaged.

In this aspect, as the main body electrode 305 is hidden, such structure is likely to be broken due to contact during maintenance operations. In other words, the main body electrode 305 is disposed at the position relatively deep inside the main body 1*a*, a position that is effective in preventing breakage or deterioration.

Further, another aspect of the present invention will be described referring to FIGS. 17 and 25.

Figure 17:
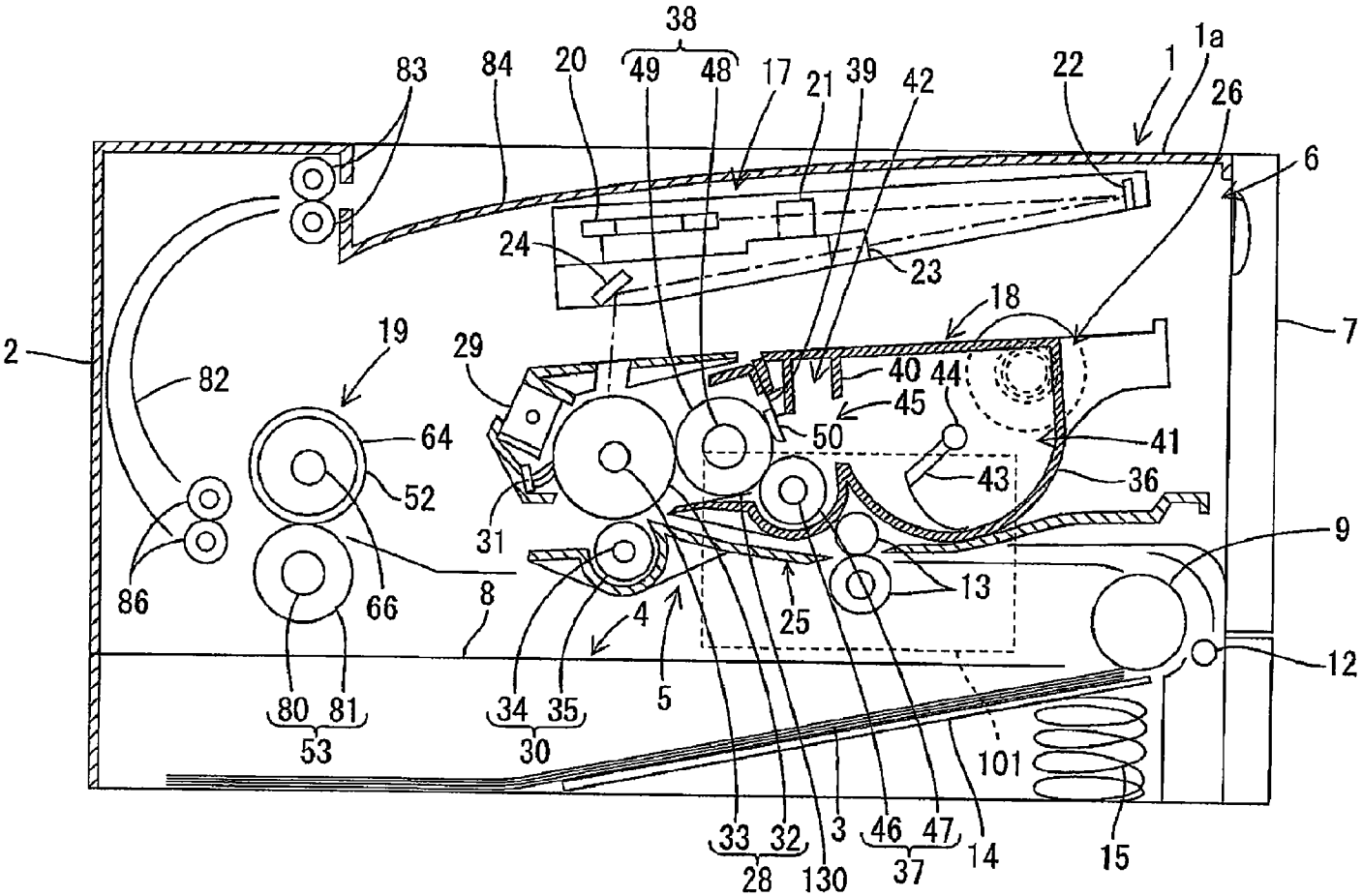
FIG. 17 is a sectional side elevation conceptually showing a laser printer according to another aspect of the present invention.
Figure 18:
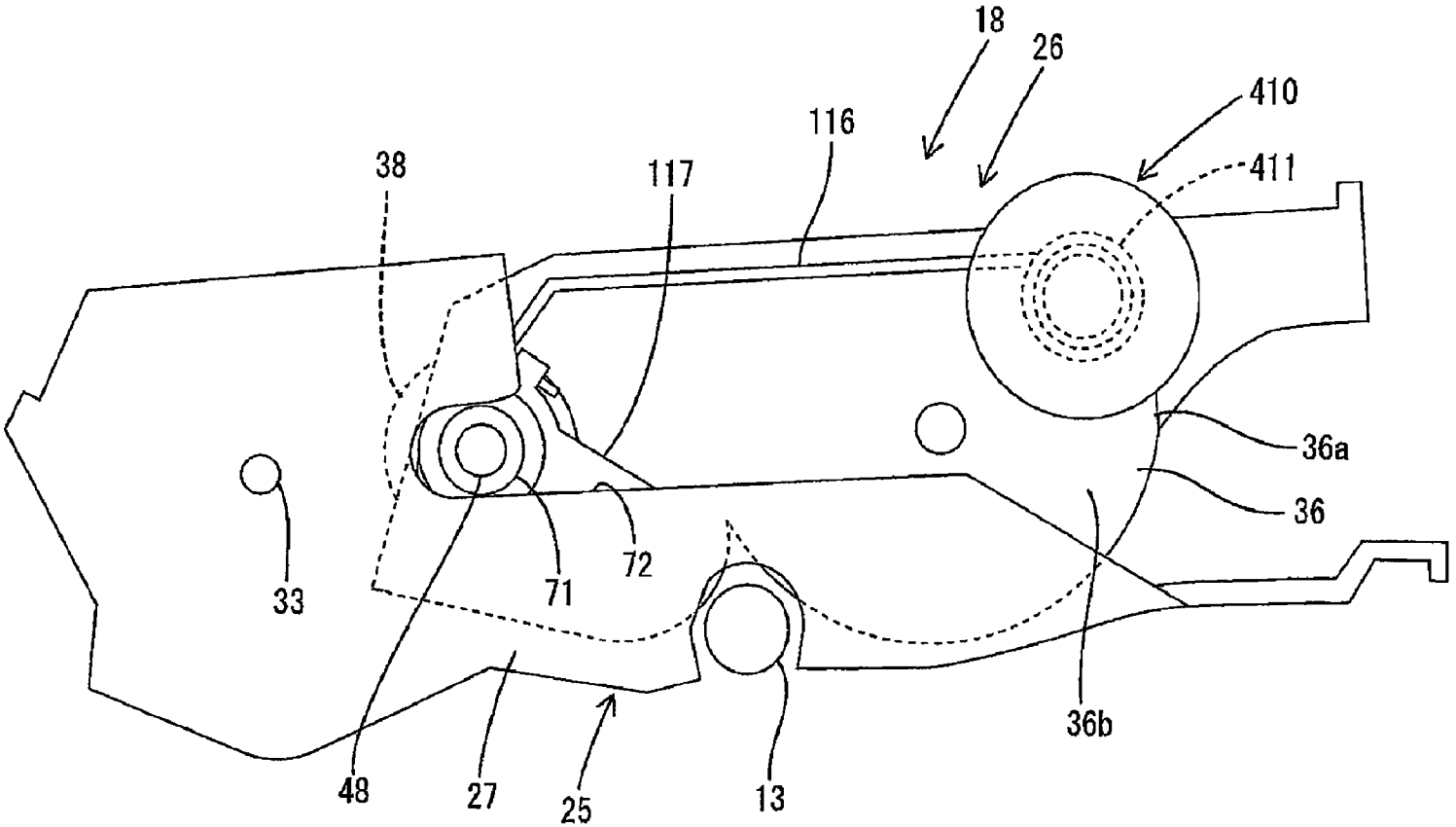
FIG. 18 is a side view conceptually showing the process cartridge employed in the laser printer according to the aspect 4.
Figure 19:
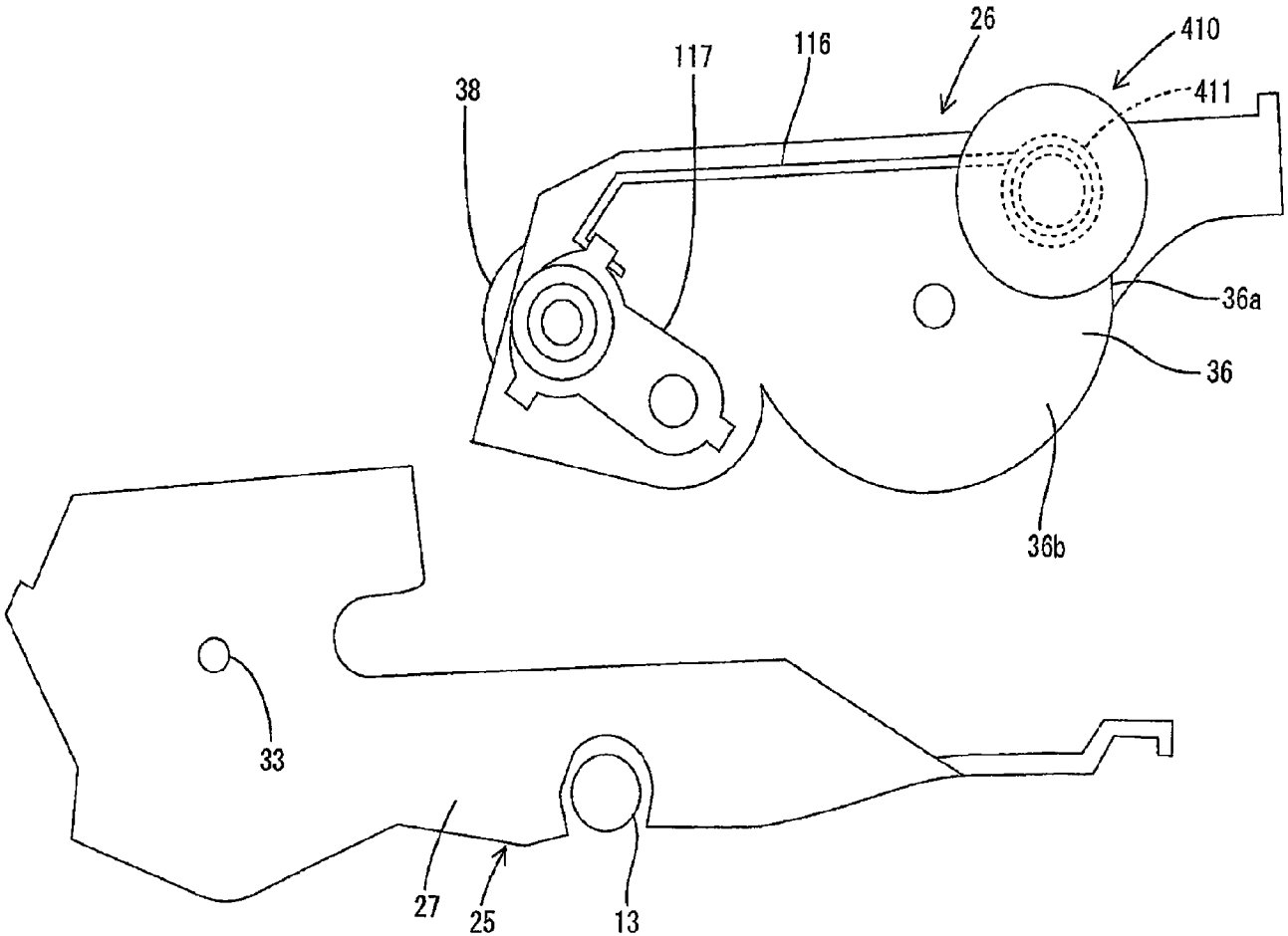
FIG. 19 is a view of the process cartridge shown in FIG. 18 having the development cartridge removed from the drum cartridge.
Figure 20:
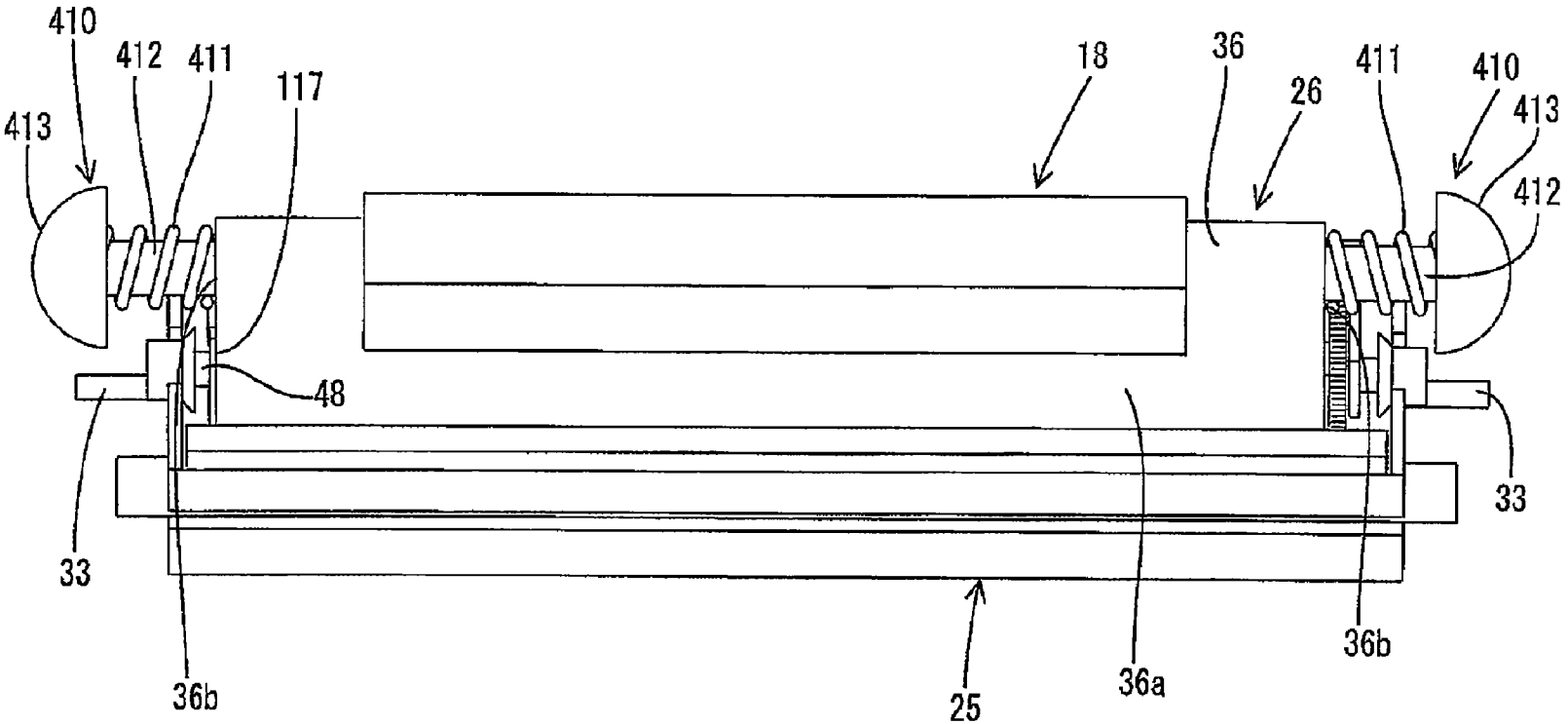
FIG. 20 is a front view of the process cartridge shown in FIG. 18 as seen from the front.
Figure 21:
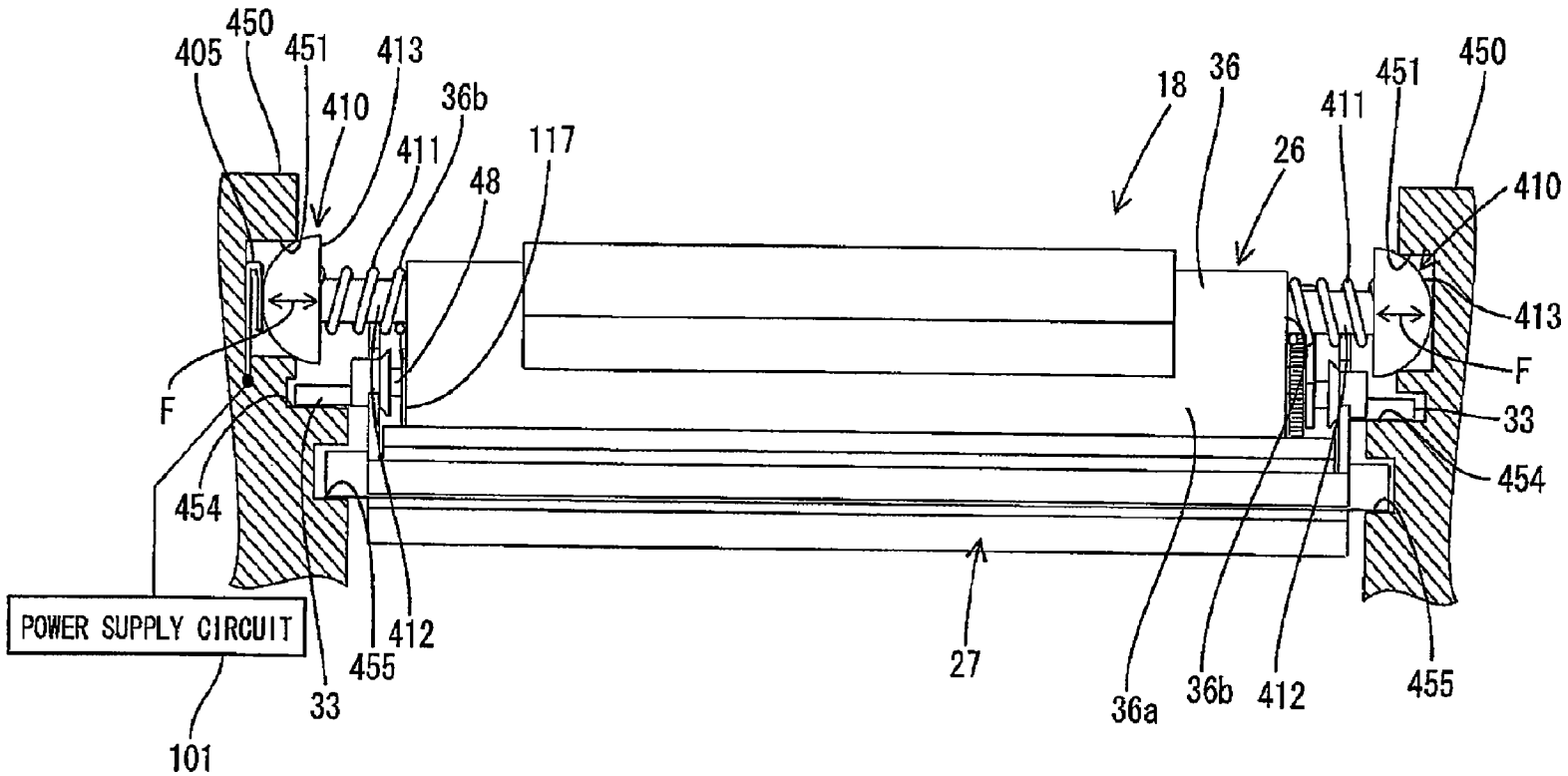
FIG. 21 is an explanatory view conceptually showing the process cartridge shown in FIG. 18 set in the main body.
Figure 22:
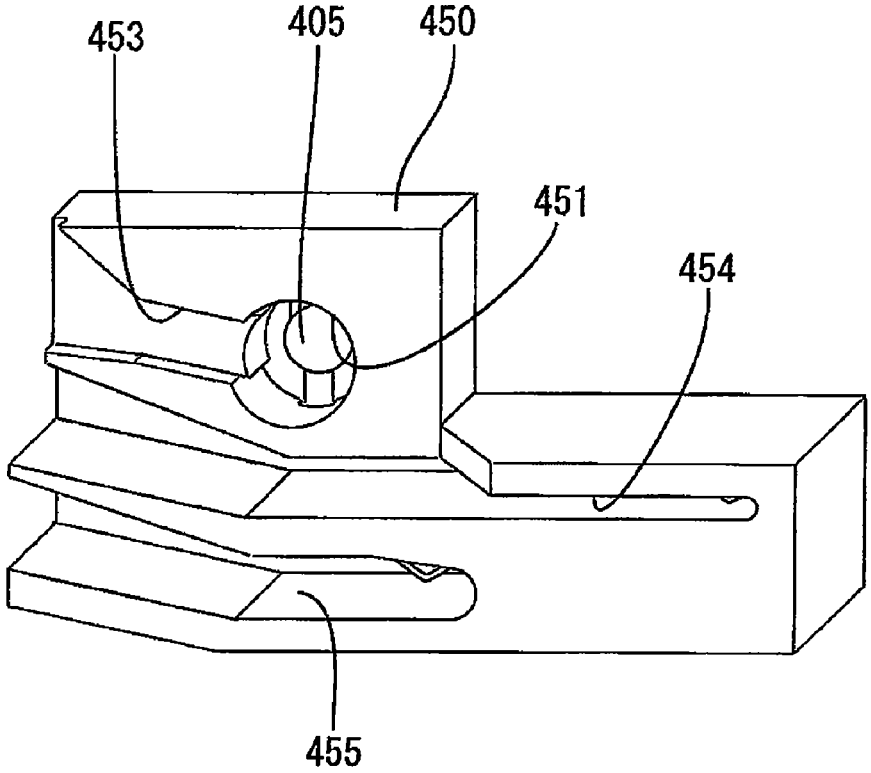
FIG. 22 is a perspective view conceptually showing an inner wall of the main body of the laser.
Figure 23:
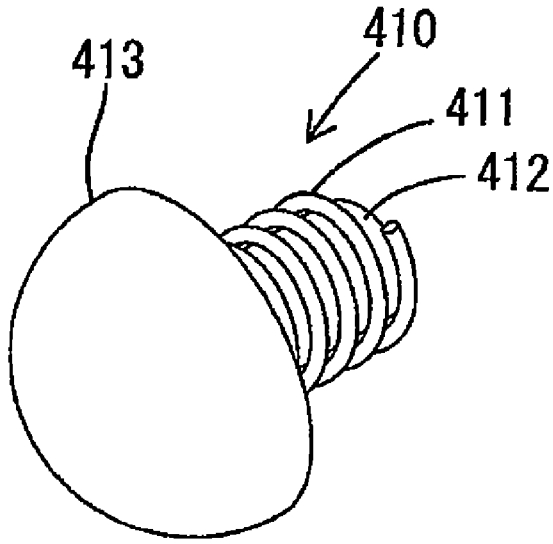
FIG. 23 is a perspective view showing a terminal at cartridge side employed in the development cartridge.
Figure 24:
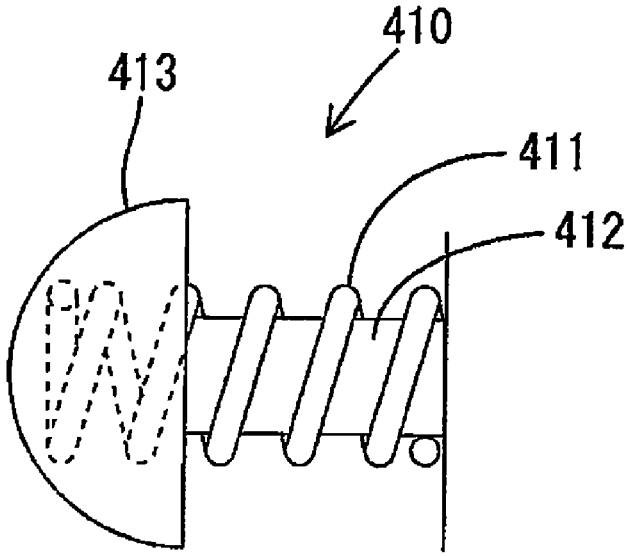
FIG. 24 is a view of the cartridge electrode shown in FIG. 23 seen from above.
Figure 26:
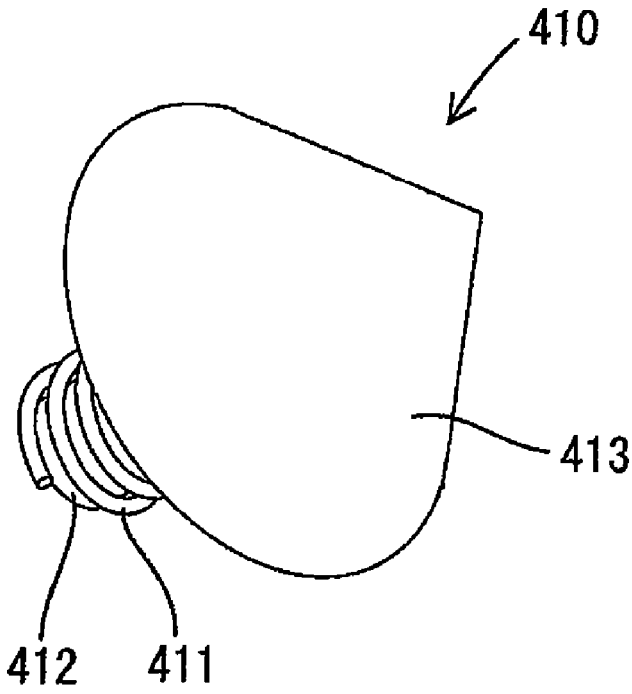
FIG. 26 is a view of the terminal shown in FIG. 23 as modified.
Figure 27:
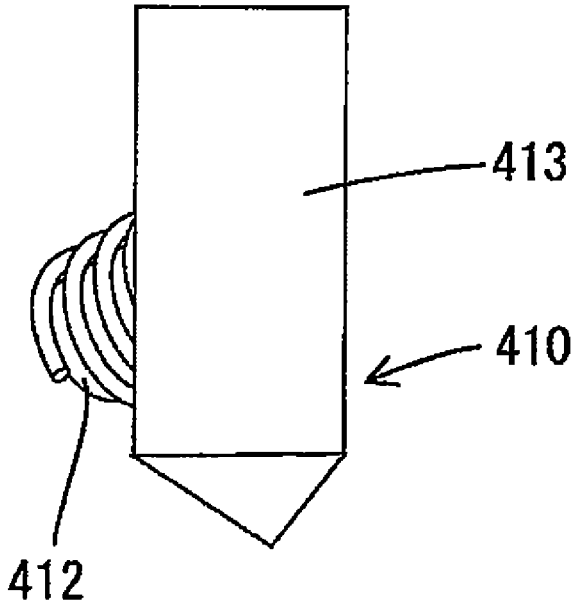
FIG. 27 is a view of the terminal shown in FIG. 23 as modified.

FIG. 17 is a sectional side elevation conceptually showing the laser printer 1 according to this aspect. FIG. 18 is a side view conceptually showing the process cartridge 18 employed in the laser printer 1. FIG. 19 is a view of the process cartridge 18 in the state where the development cartridge 26 is removed from the drum cartridge 25. FIG. 20 is a front view of the process cartridge 18 shown in FIG. 18 as seen from the front. FIG. 21 is an explanatory view conceptually showing the state where the process cartridge 18 shown in FIG. 18 is set in the main body 1*a*. FIG. 22 is a perspective view conceptually showing the inner wall of the main body 1*a* of the laser printer 1. FIG. 23 is a perspective view of a terminal at cartridge side 410 employed in the development cartridge 26. FIG. 24 is a view of the cartridge electrode 410 as seen from above. FIG. 25 is an explanatory view showing the state where the cartridge electrode 410 is installed. FIGS. 26 and 27 show modified configurations of the cartridge electrode 410.

The structure of this aspect is the same as that of the previous aspects, except that the structures of the cartridge electrode 410 and the main body electrode 405, and the drum cartridge 25 differ, thus only the differences will be described below Referring to FIG. 17, the development cartridge 26 set in the laser printer 1 can be formed as the cartridge including the developer roller 38 similar to previous aspects. It forms the process cartridge 18 together with the drum cartridge 25 as shown in FIG. 18, and is detachable with respect to the drum cartridge 25 as shown in FIG. 19.

In this aspect, the cartridge electrode 410 is not attached to the wall 36*a* at the front of the frame 36 as shown in FIG. 17, rather it is attached to the side wall 36*b* of the frame 36 as shown in FIGS. 18 and 20. Specifically, the protrusions that extend outward of both side walls 36*b* and 36*b* of the frame 36 are provided as the terminals at cartridge side 410 in the width direction (parallel to the axial direction of the developer roller 38).

The cartridge electrode 410 is extendable in the width direction (see arrow F). When the development cartridge 26 is set in the main body 1*a*, both terminals 410 and 410 are engaged with corresponding engagement holes 451, each positioned in the inner wall 450 of the main body 1*a* as shown in FIG. 21. Referring to FIGS. 21 and 22, a main body electrode 405 formed of a conductive member, which is connected to the power supply circuit 101 (power supply unit) in the main body 1*a*, is disposed on the bottom of the engagement hole 451. When the cartridge electrode 410 is engaged with the engagement hole 451, the contact member 413 of the cartridge electrode 410 is brought into contact with the main body electrode 405 so as to be electrically coupled. The contact member 413 corresponds to the contact portion.

Referring to FIGS. 23 and 24, the cartridge electrode 410 includes a conductive contact member 413 and a coil spring 411 as the urging member, which can be formed of a metallic material. A protrusion 412, positioned at the side wall 36*b* of the frame 36, is inserted to the inside of the coil spring 411. In this aspect, the urging unit is formed of the coil spring 411 and the contact member 413. The protrusion 412 serves to prevent or reduce excessive tilting of the coil spring 411. As shown in FIGS. 18 and 19, the coil spring 411 is electrically coupled with the conductive member 116. The connection between the conductive member 116 and the bearing member 117, and the support of the developer roller shaft 48 at the bearing member 117 are performed in the same manner as the aspect 1. The cartridge electrode 410 is electrically coupled with the developer roller shaft 48. In this case, the terminals at cartridge side 410 are provided at positions adjacent to side walls of the frame 36. This makes it possible to simplify the wiring for applying the voltage to the developer roller 38.

More specifically, as the conductive member 116 is disposed on the same plane (side wall 36*b* of the frame 36) from the side wall 36*b* to the wall 36*a*, conductive member 116 can be formed by punching a plate without requiring bending work.

As the unit for urging the developer roller 38 to the photosensitive drum 28 is provided further adjacent to the end, the restoring force generated upon lifting of the developer roller 38 from the photosensitive drum 28 further stabilizes the positioning of the developer roller 38.

In this aspect, the developer roller 38 is urged by the cartridge electrode 410 towards the photosensitive drum 28, and receives voltage applied from the power supply circuit 101 (power supply unit) set in the main body la via the cartridge electrode 410. The cartridge electrode 410 includes the urging unit to generate the urging force that urges the developer roller 38 to the photosensitive drum 28 in accordance with a force applied from the main body electrode 405.

Figure 25:
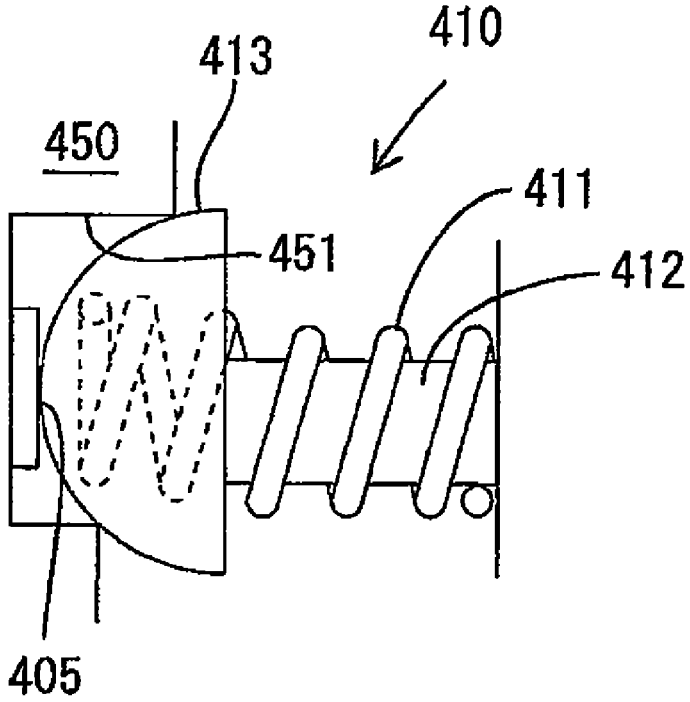
FIG. 25 is an explanatory view showing the cartridge electrode in a set state.

FIG. 25 is a view of the cartridge electrode 410 seen from above in the state where the development cartridge 26 is set in the main body 1*a*. In the state where the development cartridge 26 is set in the main body 1*a*, each of the contact members 413 of the respective terminals 410 and 410 is guided to move relative to the protrusion 412 so as to be engaged with the engagement hole 451. During the engagement, the coil spring 411 deforms in accordance with the displacement of the contact member 413. The elastic return force is generated in the coil spring 411 to further generate the urging force to urge the development cartridge 26 rearward (toward the photosensitive drum 28). In this aspect, the restoring force resulting from displacement in a lateral direction is used. That is, when the development cartridge 26 is set in the main body 1*a*, the contact member 413 is forced into the engagement hole 451. Then the contact member 413 moves toward the photosensitive drum 28 such that the coil spring 411 tilts from the lateral direction to the photosensitive drum 28. As a result, the lateral restoring force is generated in the coil spring 411 such that the development cartridge 26 is urged toward the photosensitive drum 28.

FIGS. 17 to 25 show the cartridge electrode 410 including the contact member 413 with a semi-spherical outer surface. However, the configuration of the cartridge electrode 410 is not limited to the aforementioned shape so long as it is structured to urge the developer roller 38 to the photosensitive drum 28 in accordance with the pressure applied from the main body electrode 405. Referring to FIG. 26, the cartridge electrode 410 may include the conical contact member. Alternatively, it may have a wedge-like shape as shown in FIG. 27. In case of the modified example, it is preferable to form the inclined surface on the contact member 413 in the direction of its attachment and removal for easy attachment and removal of the contact member 413. The inclined surface formed on the contact member 413 makes it possible to attach or remove the development cartridge 26 straight from the front, thus requiring no operation to rotate the development cartridge 26.

In the invention according to the above described aspects, the power supply from the main body to the developer roller and stable positioning of the developer roller to the development position may be performed without complicating the cartridge structure. The contact portion functions in supplying power from the power supply unit to the developer roller while transferring the urging force from the urging member to the developer roller. Therefore, the action of the cartridge is unlikely to be interrupted during application of voltage from the power supply unit to the developer roller.

The invention according to the above described aspects may be realized by a process cartridge which includes the photosensitive drum and the developer roller, or the development cartridge with no photosensitive drum.

In the invention according to the above identified aspects, the developer roller is structured to perform development while being in contact with the photosensitive drum via a toner.

With the development method by bringing the developer roller into contact with the photosensitive drum via a toner (contact development type), excessively high or low pressing force of the developer roller applied to the photosensitive drum may be a cause of printing failure. Accordingly, the pressing force is required to be controlled to appropriate value. In the case where the developer roller fails to follow-up the oscillation of the photosensitive drum, or each pressure force of the developer roller applied to the photosensitive drum at right and left is uneven, the end portion may have the area that is not printed periodically as shown in FIG. 29.

Figure 29:
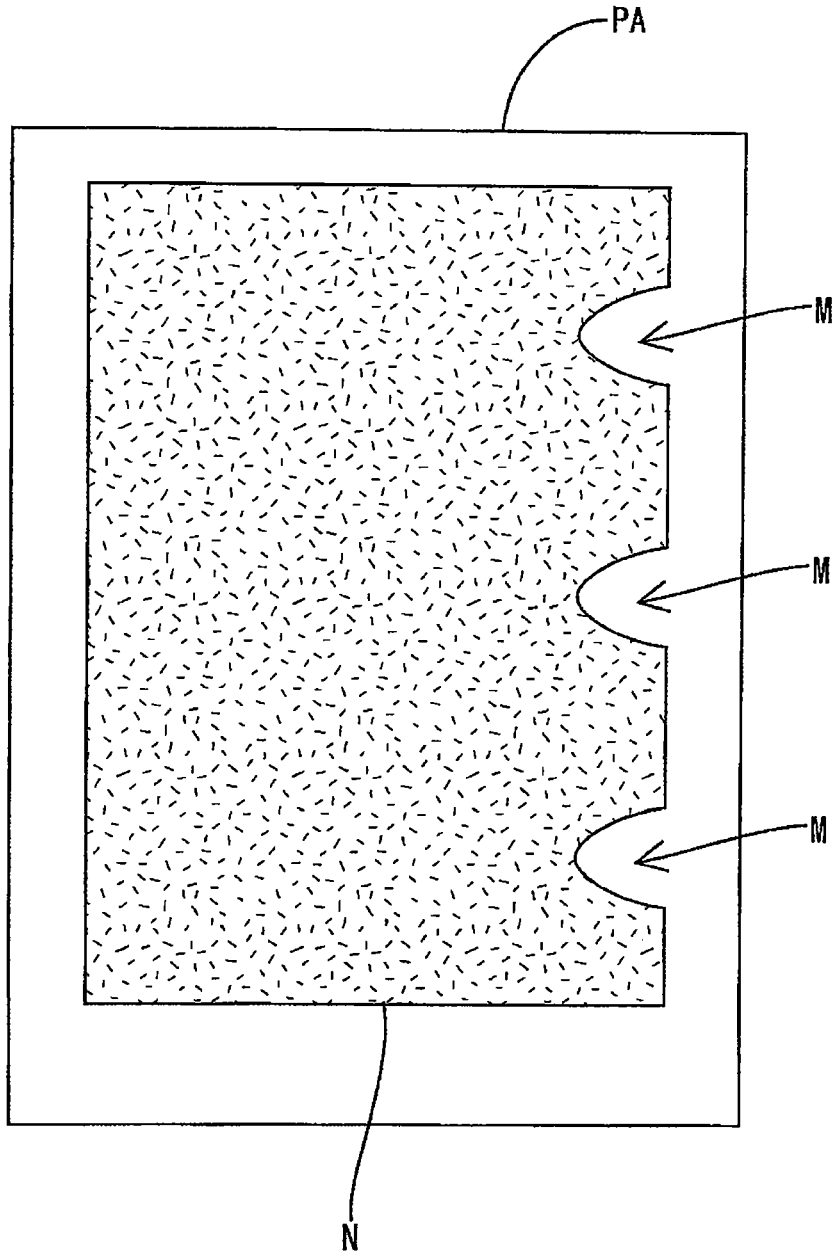
FIG. 29 is an explanatory view showing a difficulty in the generally employed apparatus.

FIG. 29 is an explanatory view that represents the printing failure which occurs when a gray level image N is printed on the entire surface of the sheet, having missing areas M which are not printed. The aforementioned failure is caused by a slight lifting of the end of the developer roller from the photosensitive drum. Especially when the rotating speed of the photosensitive drum is increased, such failure becomes more likely to occur.

As discussed in the background section, previous structures have described or shown a unit for urging the developer roller against the photosensitive drum as being provided separately from the unit for supplying power to the developer roller. The unit for supplying power is likely to interrupt the action of the cartridge, resulting in the failure as shown in FIG. 29. Especially when the contact pressure of the unit for supplying power to the developer roller is too high, or the contact with the outer wall of the cartridge may immediately cause the failure.

On the other hand, if the developer roller is structured to develop while being in contact with the photosensitive drum via the toner, the unit for supplying power to the developer roller does not interrupt the action of the cartridge. Accordingly, each operation of the developer roller and the photosensitive drum at the end portion is kept stable, thus efficiently preventing the printing failure as shown in FIG. 29.

In the invention according to above described aspects, the urging unit may be formed by either a single part or a plurality of parts. For example, the urging unit may be formed as a single part that generates the urging force such as a spring member. Alternatively, it may be formed as a combination of the part that generates the urging force and the other part. For example, it may be formed as the combination of the spring member and the part urged by the spring member.

It is to be understood that the invention is not limited to those aspects described above or to the drawings shown, and one skilled in the art will appreciate that the present invention may include aspects as described below as being within the scope of the invention.

It was previously described that the protrusion formed on the side wall of the frame 36 includes "protrusions that protrude outward of both side walls of the frame". However, the protrusion may be formed to penetrate through the side wall of the frame 36. For example, the developer roller shaft 48 of the developer roller 38 is allowed to protrude laterally such that the main body electrode performs urging. In this case, it is preferable to form a long hole in the drum cartridge 25 such that the developer roller shaft 48 is movable in the direction for urging by the main body electrode.

The structure for urging the developer roller shaft 48 by the main body electrode may be formed to allow the main body electrode to directly press the developer roller shaft 48, or to allow the terminal to urge the bearing provided to support the developer roller shaft 48.

It was previously described that the development cartridge with no photosensitive drum as an example of the "cartridge". However, the invention is not limited to the aforementioned structure. For example, it may be configured as the process cartridge including a unit of the developer roller and the photosensitive drum. In this case, the process cartridge in the aspect forms the "cartridge" defined in the invention.

It was previously described that the development method by contact of the developer roller with the photosensitive drum via the toner is employed (contact development method). However, the method (non-contact development method) without contact between the developer roller and the photosensitive drum may be employed.

Figure 28:
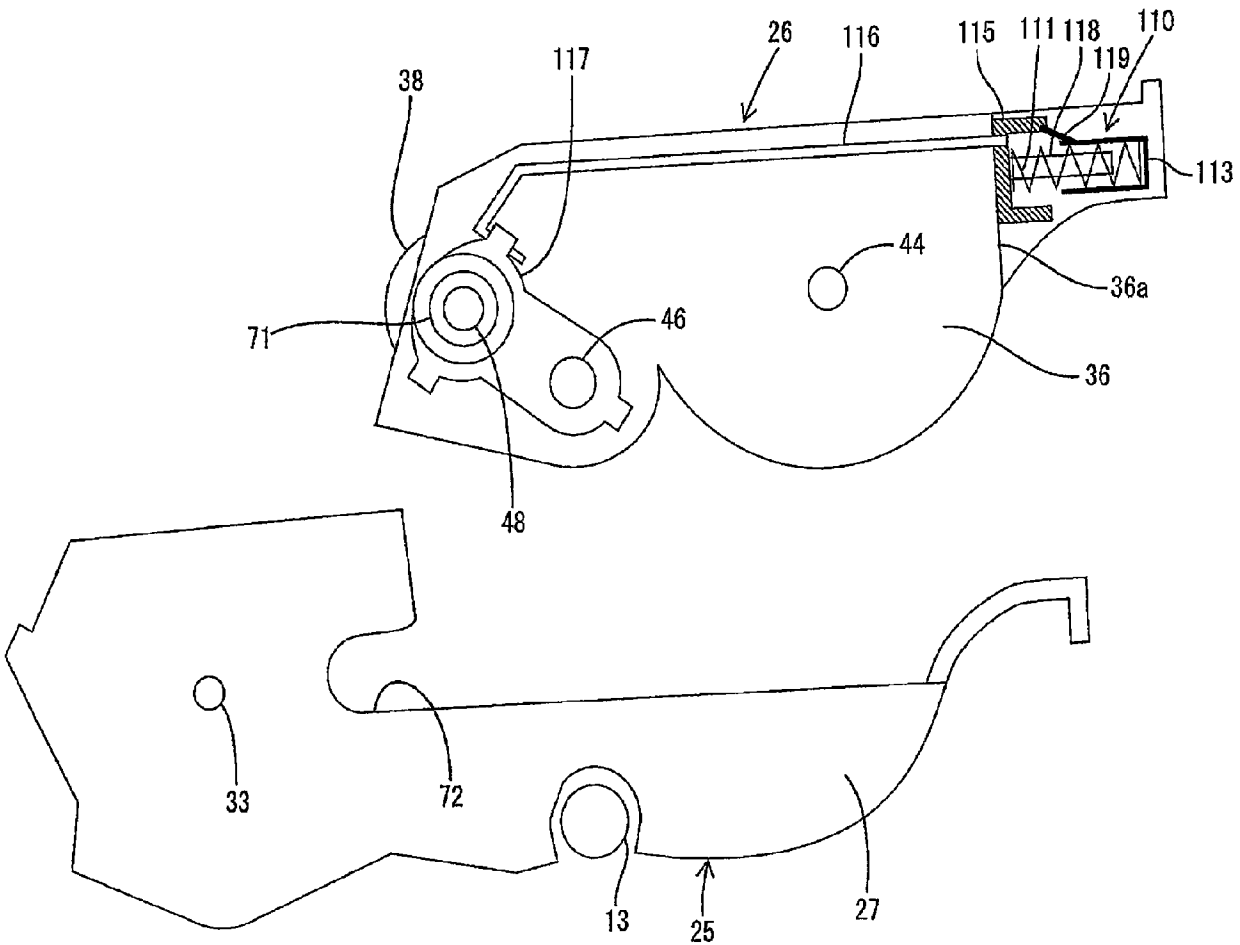
FIG. 28 is a view of the modified configuration of FIG. 5 in which the spring member 111 is formed of a nonconductive member.

It was previously described that the conductive spring member act as the urging member. However, a nonconductive urging member may be employed. The structure of the modified configuration of FIG. 5 as shown in FIG. 28 is configured so that the spring member 111 is formed of the nonconductive member (for example, nonconductive resin member) and provision of a conductive elastic lead wire 119 for the contact member 113 and the base portion 115. The main body electrode does not have to be entirely formed of the conductive member so long as at least the point for urging the cartridge electrode is formed of the conductive member.

What is claimed is:

1. A developer cartridge comprising:

a frame that defines a toner chamber and includes a wall;

a developer roller that is disposed in an area opposite from the wall with respect to the toner chamber; and a plurality of urging members disposed on the wall and the plurality of urging members being spaced apart from each other in the axial direction of the developer roller, each urging member generating a restoring force in a direction away from the developer roller, and at least one of the plurality of urging members being electrically connected to the developer roller.

2. The developer cartridge according to claim 1 further comprising:

a contact member;

wherein:

the at least one of the plurality of urging members has an end electrically connected to the developer roller and an end to be electrically connected to the contact member.

3. The developer cartridge according to claim 1 further comprising:

a guide member that guides at least one of the plurality of urging members.

4. The developer cartridge according to claim 1, wherein:

at least one of the plurality of urging members includes a base member disposed on the wall.

5. The developer cartridge according to claim 4, further comprising:

a bearing member that supports the developer roller; and a connect member that connects the base member and the bearing member.

6. The developer cartridge according to claim 1, wherein:

at least one of the plurality of urging members is electrically connected to a part disposed in the developer cartridge wherein the part is different from the developer roller.

* * * * *